US008469739B2

(12) United States Patent
Rodrigues et al.

(10) Patent No.: US 8,469,739 B2
(45) Date of Patent: Jun. 25, 2013

(54) CABLE CONNECTOR WITH BIASING ELEMENT

(75) Inventors: Julio F. Rodrigues, Collierville, TN (US); Joey D. Mango, Jr., Cordova, TN (US); Roger Phillips, Jr., Horseheads, NY (US)

(73) Assignee: Belden Inc., St. Louis, MO (US)

( * ) Notice: Subject to any disclaimer, the term of this patent is extended or adjusted under 35 U.S.C. 154(b) by 0 days.

(21) Appl. No.: 13/418,099

(22) Filed: Mar. 12, 2012

(65) Prior Publication Data

US 2012/0282804 A1 Nov. 8, 2012

Related U.S. Application Data

(63) Continuation of application No. 13/023,102, filed on Feb. 8, 2011, now Pat. No. 8,157,588.

(51) Int. Cl.
*H01R 13/62* (2006.01)

(52) U.S. Cl.
USPC ..... 439/578

(58) Field of Classification Search
USPC ..... 439/578–585
See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |
| 1,667,485 | A | 4/1928 | MacDonald |
| 1,734,506 | A | 11/1929 | Ulman |
| 1,766,869 | A | 6/1930 | Austin |
| 1,801,999 | A | 4/1931 | Bowman |
| 1,885,761 | A | 11/1932 | Peirce, Jr. |
| 2,102,495 | A | 12/1937 | England |
| 2,258,737 | A | 10/1941 | Browne |
| 2,325,549 | A | 7/1943 | Zublin |
| 2,394,351 | A | 2/1946 | Wurzburger |
| 2,460,304 | A | 2/1949 | McGee et al. |

(Continued)

FOREIGN PATENT DOCUMENTS

| | | |
|---|---|---|
| CA | 2096710 | 11/1994 |
| CN | 201149936 | 11/2008 |

(Continued)

OTHER PUBLICATIONS

International Search Report and Written Opinion for PCT/US12/23528, mailed Jun. 1, 2012, 10 pages.

(Continued)

*Primary Examiner* — Gary F. Paumen
(74) *Attorney, Agent, or Firm* — Schmeiser, Olsen & Watts LLP

(57) ABSTRACT

A coaxial cable connector for coupling a coaxial cable to a mating connector is disclosed. The coaxial cable connector may include a connector body having a forward end and a rearward cable receiving end for receiving a cable. The connector may include a nut rotatably coupled to the forward end of the connector body and an annular post disposed within the connector body for providing an electrical path between the mating connector and the coaxial cable. The connector may include a biasing element, wherein the biasing element is configured to provide a force to maintain the electrical path between the mating connector and the coaxial cable. In one embodiment, the biasing element is external to the nut and the connector body. In one embodiment, the biasing element surrounds a portion of the nut and/or the connector body.

44 Claims, 31 Drawing Sheets

U.S. PATENT DOCUMENTS

| | | | |
|---|---|---|---|
| 2,480,963 | A | 9/1949 | Quinn |
| 2,544,654 | A | 3/1951 | Browne |
| 2,544,764 | A | 3/1951 | Parkes |
| 2,549,647 | A | 4/1951 | Turenne |
| 2,694,187 | A | 11/1954 | Nash |
| 2,728,895 | A | 12/1955 | Quackenbush et al. |
| 2,754,487 | A | 7/1956 | Carr, et al. |
| 2,755,331 | A | 7/1956 | Melcher |
| 2,757,351 | A | 7/1956 | Klostermann |
| 2,761,110 | A | 8/1956 | Edlen et al. |
| 2,762,025 | A | 9/1956 | Melcher |
| 2,795,144 | A | 6/1957 | Morse |
| 2,805,399 | A | 9/1957 | Leeper |
| 2,870,420 | A | 1/1959 | Malek |
| 2,983,893 | A | 5/1961 | Jackson |
| 2,999,701 | A | 9/1961 | Blair et al. |
| 3,001,169 | A | 9/1961 | Blonder |
| 3,015,794 | A | 1/1962 | Kishbaugh |
| 3,040,288 | A | 6/1962 | Edlen et al. |
| 3,051,925 | A | 8/1962 | Felts |
| 3,091,748 | A | 5/1963 | Takes et al. |
| 3,094,364 | A | 6/1963 | Lingg |
| 3,103,548 | A | 9/1963 | Concelman |
| 3,184,706 | A | 5/1965 | Atkins |
| 3,194,292 | A | 7/1965 | Borowsky |
| 3,196,382 | A | 7/1965 | Morello, Jr. |
| 3,206,540 | A | 9/1965 | Cohen |
| 3,245,027 | A | 4/1966 | Ziegler, Jr. |
| 3,275,913 | A | 9/1966 | Blanchard et al. |
| 3,275,970 | A | 9/1966 | Johanson et al. |
| 3,278,890 | A | 10/1966 | Cooney |
| 3,281,757 | A | 10/1966 | Bonhomme |
| 3,292,136 | A | 12/1966 | Somerset |
| 3,295,076 | A | 12/1966 | Kraus |
| 3,297,979 | A | 1/1967 | O'Keefe et al. |
| 3,320,575 | A | 5/1967 | Brown et al. |
| 3,321,732 | A | 5/1967 | Forney, Jr. |
| 3,336,562 | A | 8/1967 | McCormick et al. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,384,703 | A | 5/1968 | Forney et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler et al. |
| 3,465,281 | A | 9/1969 | Florer |
| 3,467,940 | A | 9/1969 | Wallo |
| 3,471,158 | A | 10/1969 | Solins |
| 3,475,545 | A | 10/1969 | Stark et al. |
| 3,494,400 | A | 2/1970 | McCoy et al. |
| 3,498,647 | A | 3/1970 | Schroder |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,538,464 | A | 11/1970 | Walsh |
| 3,544,705 | A | 12/1970 | Winston |
| 3,551,882 | A | 12/1970 | O'Keefe |
| 3,564,487 | A | 2/1971 | Upstone et al. |
| 3,573,677 | A | 4/1971 | Detar |
| 3,579,155 | A | 5/1971 | Tuchto |
| 3,587,033 | A | 6/1971 | Brorein et al. |
| 3,591,208 | A | 7/1971 | Nicolaus |
| 3,594,694 | A | 7/1971 | Clark |
| 3,601,776 | A | 8/1971 | Curl |
| 3,613,050 | A | 10/1971 | Andrews |
| 3,629,792 | A | 12/1971 | Dorrell |
| 3,633,150 | A | 1/1972 | Swartz |
| 3,633,944 | A | 1/1972 | Hamburg |
| 3,644,874 | A | 2/1972 | Hutter |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,444 | A | 7/1972 | Stevens et al. |
| 3,678,445 | A | 7/1972 | Brancaleone |
| 3,678,455 | A | 7/1972 | Levey |
| 3,680,034 | A | 7/1972 | Chow et al. |
| 3,681,739 | A | 8/1972 | Kornick |
| 3,683,320 | A | 8/1972 | Woods et al. |
| 3,684,321 | A | 8/1972 | Hundhausen et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,721,869 | A | 3/1973 | Paoli |
| 3,739,076 | A | 6/1973 | Schwartz |
| 3,743,979 | A | 7/1973 | Schor |
| 3,744,007 | A | 7/1973 | Horak |
| 3,744,011 | A | 7/1973 | Blanchenot |
| 3,745,514 | A | 7/1973 | Brishka |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,870,978 | A | 3/1975 | Dreyer |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,953,098 | A | 4/1976 | Avery et al. |
| 3,960,428 | A | 6/1976 | Naus et al. |
| 3,961,294 | A | 6/1976 | Hollyday |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,012,105 | A | 3/1977 | Biddle |
| 4,017,139 | A | 4/1977 | Nelson |
| 4,022,966 | A | 5/1977 | Gajajiva |
| 4,030,798 | A | 6/1977 | Paoli |
| 4,045,706 | A | 8/1977 | Daffner et al. |
| 4,046,451 | A | 9/1977 | Juds et al. |
| 4,051,447 | A | 9/1977 | Heckman, Jr. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,109,126 | A | 8/1978 | Halbeck |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,172,385 | A | 10/1979 | Cristensen |
| 4,173,385 | A | 11/1979 | Fenn et al. |
| 4,174,875 | A | 11/1979 | Wilson et al. |
| 4,187,481 | A | 2/1980 | Boutros |
| 4,191,408 | A | 3/1980 | Acker |

4,225,162 A 9/1980 Dola
4,227,765 A 10/1980 Neumann et al.
4,229,714 A 10/1980 Yu
4,235,461 A 11/1980 Normark
4,250,348 A 2/1981 Kitagawa
4,255,011 A 3/1981 Davis et al.
4,258,943 A 3/1981 Vogt et al.
4,280,749 A 7/1981 Hemmer
4,285,564 A 8/1981 Spinner
4,290,663 A 9/1981 Fowler et al.
4,296,986 A 10/1981 Herrmann, Jr.
4,307,926 A 12/1981 Smith
4,322,121 A 3/1982 Riches et al.
4,326,769 A 4/1982 Dorsey et al.
4,339,166 A 7/1982 Dayton
4,340,269 A 7/1982 McGeary
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,406,483 A 9/1983 Perlman
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,444,453 A 4/1984 Kirby et al.
4,452,503 A 6/1984 Forney, Jr.
4,456,323 A 6/1984 Pitcher et al.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,484,792 A 11/1984 Tengler et al.
4,484,796 A 11/1984 Sato et al.
4,490,576 A 12/1984 Bolante et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,633 A 10/1985 McGeary
4,545,637 A 10/1985 Bosshard et al.
4,557,546 A 12/1985 Dreyer
4,557,654 A 12/1985 Masuda et al.
4,561,716 A 12/1985 Acke
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney et al.
4,596,434 A 6/1986 Saba et al.
4,596,435 A 6/1986 Bickford
4,597,620 A 7/1986 Lindner et al.
4,597,621 A 7/1986 Burns
4,598,959 A 7/1986 Selvin
4,598,961 A 7/1986 Cohen
4,600,263 A 7/1986 DeChamp et al.
4,613,119 A 9/1986 Hardtke
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,655,534 A 4/1987 Stursa
4,660,921 A 4/1987 Hauver
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,702,710 A 10/1987 Dittman et al.
4,703,987 A 11/1987 Gallusser et al.
4,703,988 A 11/1987 Raux et al.
4,717,355 A 1/1988 Mattis
4,720,155 A 1/1988 Schildkraut et al.
4,731,282 A 3/1988 Tsukagoshi et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,777,669 A 10/1988 Rogus
4,789,355 A 12/1988 Lee
4,793,821 A 12/1988 Fowler et al.
4,797,120 A 1/1989 Ulery
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,820,446 A 4/1989 Prud'Homme
4,824,400 A 4/1989 Spinner
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,878,697 A 11/1989 Henry
4,887,950 A 12/1989 Sakayori et al.
4,892,275 A 1/1990 Szegda
4,897,008 A 1/1990 Parks
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,971,727 A 11/1990 Takahashi et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa 5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gaver et al.
5,073,129 A 12/1991 Szegda
5,080,600 A 1/1992 Baker et al.
5,083,943 A 1/1992 Tarrant
5,100,341 A 3/1992 Czyz et al.
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,192,219 A 3/1993 Fowler et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,221,216 A 6/1993 Gabany et al.
5,227,093 A 7/1993 Cole et al.
5,227,587 A 7/1993 Paterek
5,247,424 A 9/1993 Harris et al.
5,269,701 A 12/1993 Leibfried, Jr.
5,280,254 A 1/1994 Hunter et al.
5,281,167 A 1/1994 Le et al.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,316,499 A 5/1994 Scannelli et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,359,735 A 11/1994 Stockwell
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,397,252 A 3/1995 Wang
5,409,398 A 4/1995 Chadbourne et al.
5,413,504 A 5/1995 Kloecker et al.
5,417,588 A 5/1995 Olson et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,464,661 A 11/1995 Lein et al.
5,466,173 A 11/1995 Down
5,470,257 A 11/1995 Szegda
5,474,478 A 12/1995 Ballog
5,490,033 A 2/1996 Cronin
5,490,801 A 2/1996 Fisher et al.
5,494,454 A 2/1996 Johnsen
5,496,076 A 3/1996 Lin
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,595,502 A 1/1997 Allison
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,690,503 A 11/1997 Konda et al.
5,695,365 A 12/1997 Kennedy et al.
5,696,196 A 12/1997 DiLeo
5,702,262 A 12/1997 Brown et al.
5,702,263 A 12/1997 Baumann et al.
5,722,856 A 3/1998 Fuchs et al.
5,735,704 A 4/1998 Anthony
5,746,617 A 5/1998 Porter et al.
5,746,619 A 5/1998 Harting et al.
5,769,652 A 6/1998 Wider
5,770,216 A 6/1998 Mitchnick et al.
5,775,927 A 7/1998 Wider
5,788,666 A 8/1998 Atanasoska
5,857,865 A 1/1999 Shimirak et al.
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,949,029 A 9/1999 Crotzer et al.
5,956,365 A 9/1999 Haissig
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,019,636 A 2/2000 Langham
6,022,237 A 2/2000 Esh
6,032,358 A 3/2000 Wild
6,042,422 A 3/2000 Youtsey
6,048,229 A 4/2000 Lazaro, Jr.
6,053,769 A 4/2000 Kubota et al.
6,053,777 A 4/2000 Boyle
6,083,053 A 7/2000 Anderson et al.
6,089,903 A 7/2000 Stafford Gray et al.
6,089,912 A 7/2000 Tallis et al.
6,089,913 A 7/2000 Holliday
6,106,314 A 8/2000 McLean et al.
6,117,539 A 9/2000 Crotzer et al.
6,123,567 A 9/2000 McCarthy
6,123,581 A 9/2000 Stabile et al.
6,146,179 A 11/2000 Denny et al.
6,146,197 A 11/2000 Holliday et al.
6,152,753 A 11/2000 Johnson et al.
6,153,830 A 11/2000 Montena 6,168,211 B1 1/2001 Schorn-Gilson
6,180,221 B1 1/2001 Crotzer et al.
6,210,216 B1 4/2001 Tso-Chin et al.
6,210,222 B1 4/2001 Langham et al.
6,217,383 B1 4/2001 Holland et al.
RE37,153 E 5/2001 Henszey et al.
6,239,359 B1 5/2001 Lilienthal et al.
6,241,553 B1 6/2001 Hsia
6,251,553 B1 6/2001 Baur et al.
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,344,736 B1 2/2002 Kerrigan et al.
6,358,077 B1 3/2002 Young
6,375,866 B1 4/2002 Paneccasio et al.
6,390,825 B1 5/2002 Handley et al.
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,416,847 B1 7/2002 Lein et al.
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,465,550 B1 10/2002 Kleyer et al.
6,468,100 B1 10/2002 Meyer et al.
6,478,618 B2 11/2002 Wong
6,491,546 B1 12/2002 Perry
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,561,841 B2 5/2003 Norwood et al.
6,572,419 B2 6/2003 Feye-Homann
6,576,833 B2 6/2003 Covaro et al.
6,619,876 B2 9/2003 Vaitkus et al.
6,621,386 B2 9/2003 Drackner et al.
6,634,906 B1 10/2003 Yeh
6,674,012 B2 1/2004 Beele
6,676,446 B2 1/2004 Montena
6,683,253 B1 1/2004 Lee
6,692,285 B2 2/2004 Islam
6,692,286 B1 2/2004 De Cet
6,712,631 B1 3/2004 Youtsey
6,716,041 B2 4/2004 Ferderer et al.
6,716,062 B1 4/2004 Palinkas et al.
6,716,072 B1 4/2004 Downes
6,733,336 B1 5/2004 Montena et al.
6,733,337 B2 5/2004 Kodaira
6,767,248 B1 7/2004 Hung
6,769,926 B1 8/2004 Montena
6,780,052 B2 8/2004 Montena et al.
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,830,479 B2 12/2004 Holliday
6,848,939 B2 2/2005 Stirling
6,848,940 B2 2/2005 Montena
6,884,113 B1 4/2005 Montena
6,884,115 B2 4/2005 Malloy
6,898,940 B2 5/2005 Gram et al.
6,910,910 B2 6/2005 Cairns
6,921,283 B2 7/2005 Zahlit et al.
6,929,265 B2 8/2005 Holland et al.
6,929,508 B1 8/2005 Holland
6,939,169 B2 9/2005 Islam et al.
6,971,912 B2 12/2005 Montena et al.
7,011,547 B1 3/2006 Wu
7,026,382 B2 4/2006 Akiba et al.
7,029,326 B2 4/2006 Montena
7,070,447 B1 7/2006 Montena
7,070,477 B2 7/2006 Morisawa et al.
7,086,897 B2 8/2006 Montena
7,097,499 B1 8/2006 Purdy
7,097,500 B2 8/2006 Montena
7,102,868 B2 9/2006 Montena
7,114,990 B2 10/2006 Bence et al.
7,118,416 B2 10/2006 Montena et al.
7,125,283 B1 10/2006 Lin
7,128,605 B2 10/2006 Montena
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,172,380 B2 2/2007 Lees et al.
7,172,381 B2 2/2007 Miyazaki
7,179,121 B1 2/2007 Burris et al.
7,186,127 B2 3/2007 Montena
7,189,097 B2 3/2007 Benham
7,192,308 B2 3/2007 Rodrigues et al.
7,207,820 B1 4/2007 Montena
7,229,303 B2 6/2007 Vermoesen et al.
7,252,546 B1 8/2007 Holland et al.
7,255,598 B2 8/2007 Montena et al.
7,264,503 B2 9/2007 Montena
7,299,520 B2 11/2007 Huang
7,299,550 B2 11/2007 Montena
7,300,309 B2 11/2007 Montena
7,354,309 B2 4/2008 Palinkas
7,371,112 B2 5/2008 Burris et al.
7,375,533 B2 5/2008 Gale
7,393,245 B2 7/2008 Palinkas et al.
7,402,063 B2 7/2008 Montena
7,404,737 B1 7/2008 Youtsey
7,452,237 B1 11/2008 Montena
7,452,239 B2 11/2008 Montena
7,455,550 B1 11/2008 Sykes
7,462,068 B2 12/2008 Amidon
7,473,128 B2 1/2009 Montena
7,476,127 B1 1/2009 Wei
7,479,035 B2 1/2009 Bence et al.
7,488,210 B1 2/2009 Burris et al.
7,494,355 B2 2/2009 Hughes et al.
7,497,729 B1 3/2009 Wei
7,500,874 B2 3/2009 Montena
7,507,117 B2 3/2009 Amidon
7,513,795 B1 4/2009 Shaw
7,544,094 B1 6/2009 Paglia et al.
7,544,097 B2 6/2009 Hong et al.
7,566,236 B2 7/2009 Malloy et al.
D597,959 S 8/2009 Malloy
7,568,945 B2 8/2009 Chee et al.
7,587,244 B2 9/2009 Olbertz
7,607,942 B1 10/2009 Van Swearingen
7,661,984 B2 2/2010 McMullen et al.
7,674,132 B1 3/2010 Chen
7,682,177 B2 3/2010 Berthet
7,727,011 B2 6/2010 Montena et al.
7,753,705 B2 7/2010 Montena
7,753,727 B1 7/2010 Islam et al.
7,794,275 B2 9/2010 Rodrigues
7,806,714 B2 10/2010 Williams et al.
7,806,725 B1 10/2010 Chen
7,811,133 B2 10/2010 Gray
7,824,216 B2 11/2010 Purdy
7,828,595 B2 11/2010 Mathews
7,828,596 B2 11/2010 Malak
7,830,154 B2 11/2010 Gale
7,833,053 B2 11/2010 Mathews
7,845,976 B2 12/2010 Mathews
7,845,978 B1 12/2010 Chen
7,850,487 B1 12/2010 Wei
7,857,661 B1 12/2010 Islam

| | | | |
|---|---|---|---|
| 7,874,870 | B1 | 1/2011 | Chen |
| 7,887,354 | B2 | 2/2011 | Holliday |
| 7,892,004 | B2 | 2/2011 | Hertzler et al. |
| 7,892,005 | B2 | 2/2011 | Haube |
| 7,892,024 | B1 | 2/2011 | Chen |
| 7,927,135 | B1 | 4/2011 | Wlos |
| 7,934,954 | B1 | 5/2011 | Chawgo et al. |
| 7,950,958 | B2 | 5/2011 | Mathews |
| 7,955,126 | B2 | 6/2011 | Bence et al. |
| 7,972,158 | B2 | 7/2011 | Wild et al. |
| 8,029,315 | B2 | 10/2011 | Purdy et al. |
| 8,062,044 | B2 | 11/2011 | Montena et al. |
| 8,062,063 | B2 | 11/2011 | Malloy et al. |
| 8,071,174 | B2 | 12/2011 | Krenceski |
| 8,075,337 | B2 | 12/2011 | Malloy et al. |
| 8,075,338 | B1 | 12/2011 | Montena |
| 8,079,860 | B1 | 12/2011 | Zraik |
| 8,113,875 | B2 | 2/2012 | Malloy et al. |
| 8,152,551 | B2 | 4/2012 | Zraik |
| 8,157,589 | B2 | 4/2012 | Krenceski et al. |
| 8,167,635 | B1 | 5/2012 | Mathews |
| 8,167,636 | B1 | 5/2012 | Montena |
| 8,167,646 | B1 | 5/2012 | Mathews |
| 8,172,612 | B2 | 5/2012 | Bence et al. |
| 8,192,237 | B2 | 6/2012 | Purdy et al. |
| 8,231,412 | B2 | 7/2012 | Paglia et al. |
| 8,241,060 | B2 * | 8/2012 | Sykes ..... 439/578 |
| 8,287,320 | B2 | 10/2012 | Purdy et al. |
| 8,288,018 | B2 | 10/2012 | Abe et al. |
| 8,313,345 | B2 | 11/2012 | Purdy |
| 8,313,353 | B2 | 11/2012 | Purdy et al. |
| 8,323,060 | B2 | 12/2012 | Purdy et al. |
| 2002/0013088 | A1 | 1/2002 | Rodrigues et al. |
| 2002/0038720 | A1 | 4/2002 | Kai et al. |
| 2003/0068924 | A1 | 4/2003 | Montena |
| 2003/0214370 | A1 | 11/2003 | Allison et al. |
| 2003/0224657 | A1 | 12/2003 | Malloy |
| 2004/0018312 | A1 | 1/2004 | Halladay |
| 2004/0048514 | A1 | 3/2004 | Kodaira |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0224552 | A1 | 11/2004 | Hagmann et al. |
| 2004/0229504 | A1 | 11/2004 | Liu |
| 2005/0042919 | A1 | 2/2005 | Montena |
| 2005/0109994 | A1 | 5/2005 | Matheson et al. |
| 2005/0164553 | A1 | 7/2005 | Montena |
| 2005/0181652 | A1 | 8/2005 | Montena et al. |
| 2005/0181668 | A1 | 8/2005 | Montena et al. |
| 2005/0208827 | A1 | 9/2005 | Burris et al. |
| 2005/0233636 | A1 | 10/2005 | Rodrigues et al. |
| 2006/0081141 | A1 | 4/2006 | Deneka |
| 2006/0099853 | A1 | 5/2006 | Sattele et al. |
| 2006/0110977 | A1 | 5/2006 | Matthews |
| 2006/0154519 | A1 | 7/2006 | Montena |
| 2007/0026734 | A1 | 2/2007 | Bence et al. |
| 2007/0049113 | A1 | 3/2007 | Rodrigues et al. |
| 2007/0077360 | A1 | 4/2007 | Kashiwagi et al. |
| 2007/0123101 | A1 | 5/2007 | Palinkas |
| 2007/0155232 | A1 | 7/2007 | Burris et al. |
| 2007/0175027 | A1 | 8/2007 | Khemakhem et al. |
| 2007/0243759 | A1 | 10/2007 | Rodrigues et al. |
| 2007/0243762 | A1 | 10/2007 | Burke et al. |
| 2008/0102696 | A1 | 5/2008 | Montena |
| 2008/0113554 | A1 | 5/2008 | Montena |
| 2008/0289470 | A1 | 11/2008 | Aston |
| 2008/0311790 | A1 | 12/2008 | Malloy et al. |
| 2009/0029590 | A1 | 1/2009 | Sykes et al. |
| 2009/0098770 | A1 | 4/2009 | Bence et al. |
| 2009/0176396 | A1 | 7/2009 | Mathews |
| 2009/0220794 | A1 | 9/2009 | O'Neill et al. |
| 2010/0055978 | A1 | 3/2010 | Montena |
| 2010/0081321 | A1 | 4/2010 | Malloy et al. |
| 2010/0081322 | A1 | 4/2010 | Malloy et al. |
| 2010/0105246 | A1 | 4/2010 | Burris et al. |
| 2010/0233901 | A1 | 9/2010 | Wild et al. |
| 2010/0233902 | A1 | 9/2010 | Youtsey |
| 2010/0239871 | A1 | 9/2010 | Scheffer et al. |
| 2010/0255720 | A1 | 10/2010 | Radzik et al. |
| 2010/0255721 | A1 | 10/2010 | Purdy et al. |
| 2010/0279548 | A1 | 11/2010 | Montena et al. |
| 2010/0297871 | A1 | 11/2010 | Haube |
| 2010/0297875 | A1 | 11/2010 | Purdy et al. |
| 2011/0021072 | A1 | 1/2011 | Purdy |
| 2011/0027039 | A1 | 2/2011 | Blair |
| 2011/0053413 | A1 | 3/2011 | Mathews |
| 2011/0111623 | A1 | 5/2011 | Burris et al. |
| 2011/0117774 | A1 | 5/2011 | Malloy et al. |
| 2011/0143567 | A1 | 6/2011 | Purdy et al. |
| 2011/0200834 | A1 | 8/2011 | Krenceski |
| 2011/0230089 | A1 | 9/2011 | Amidon et al. |
| 2011/0230091 | A1 | 9/2011 | Krenceski et al. |
| 2011/0232937 | A1 | 9/2011 | Montena et al. |
| 2011/0279039 | A1 | 11/2011 | Kishimoto |
| 2012/0021642 | A1 | 1/2012 | Zraik |
| 2012/0094532 | A1 | 4/2012 | Montena |
| 2012/0122329 | A1 | 5/2012 | Montena |
| 2012/0145454 | A1 | 6/2012 | Montena |
| 2012/0171894 | A1 | 7/2012 | Malloy et al. |
| 2012/0196476 | A1 | 8/2012 | Haberek et al. |
| 2012/0202378 | A1 | 8/2012 | Krenceski et al. |
| 2012/0214342 | A1 | 8/2012 | Mathews |
| 2012/0225581 | A1 | 9/2012 | Amidon et al. |
| 2012/0252263 | A1 | 10/2012 | Ehret et al. |
| 2012/0264332 | A1 | 10/2012 | Paglia et al. |
| 2012/0270428 | A1 | 10/2012 | Purdy et al. |
| 2012/0315788 | A1 | 12/2012 | Montena |
| 2013/0034983 | A1 | 2/2013 | Purdy et al. |

FOREIGN PATENT DOCUMENTS

| | | |
|---|---|---|
| CN | 201149937 | 11/2008 |
| CN | 201178228 | 1/2009 |
| DE | 47 931 | 10/1888 |
| DE | 1 02 289 | 7/1897 |
| DE | 11 17 687 | 11/1961 |
| DE | 11 91 880 | 12/1965 |
| DE | 15 15 398 | 4/1970 |
| DE | 22 21 936 | 11/1973 |
| DE | 22 61 973 | 6/1974 |
| DE | 22 25 764 | 12/1974 |
| DE | 32 11 008 | 10/1983 |
| DE | 90 01 608 | 4/1990 |
| DE | 41 28 551 | 3/1992 |
| DE | 44 39 852 | 5/1996 |
| DE | 199 57 518 | 9/2001 |
| EP | 0 167 738 | 1/1985 |
| EP | 0 721 04 | 1/1986 |
| EP | 0 116 157 | 10/1986 |
| EP | 0 265 276 | 4/1988 |
| EP | 0 428 424 | 5/1991 |
| EP | 1 191 268 | 3/2002 |
| EP | 1 501 159 | 1/2005 |
| EP | 1 548 898 | 6/2005 |
| EP | 1 701 410 | 9/2006 |
| FR | 2232846 | 6/1974 |
| FR | 2234680 | 1/1975 |
| FR | 2312918 | 12/1976 |
| FR | 2462798 | 2/1981 |
| FR | 2494508 | 5/1982 |
| FR | 2524722 | 10/1983 |
| GB | 0 589 697 | 6/1947 |
| GB | 1 087 228 | 10/1967 |
| GB | 1 270 846 | 4/1972 |
| GB | 1 401 373 | 7/1975 |
| GB | 2 019 665 | 10/1979 |
| GB | 2 079 549 | 7/1981 |
| GB | 2 252 677 | 8/1992 |
| GB | 2 264 201 | 8/1993 |
| GB | 2 331 634 | 5/1999 |
| JP | 03-280369 | 3/1990 |
| JP | 3071571 | 3/1991 |
| JP | 3280369 | 12/1991 |
| JP | 10-228948 | 8/1998 |
| JP | 4503793 | 1/2002 |
| JP | 2002-075556 | 3/2002 |
| JP | 2004-176005 | 6/2004 |
| KR | 100622526 | 9/2006 |

| | | |
|---|---|---|
| TW | 427044 | 3/2001 |
| WO | WO-87/00351 | 1/1987 |
| WO | WO-93/24973 | 12/1993 |
| WO | WO-96/08854 | 3/1996 |
| WO | WO-01/86756 | 11/2001 |
| WO | WO-02/069457 | 9/2002 |
| WO | WO-2004/013883 | 2/2004 |
| WO | WO-2006/081141 | 8/2006 |
| WO | WO-2008/066995 | 6/2008 |
| WO | WO-2010/054021 | 5/2010 |
| WO | WO-2010/054026 | 5/2010 |
| WO | WO-2011/128665 | 10/2011 |
| WO | WO-2011/128666 | 10/2011 |
| WO | WO-2012/061379 | 5/2012 |

OTHER PUBLICATIONS

U.S. Appl. No. 13/652,073.
U.S. Appl. No. 13/652,124.
U.S. Appl. No. 13/659,298.
U.S. Appl. No. 61/180,835, filed May 22, 2009, Eric Purdy.
U.S. Appl. No. 61/554,572.
Digicon AVL Connector, Arris Group Inc., http://www.arrisi.com/special/digiconAVL.asp, retrieved on Apr. 22, 2010, 3 pages.
EP Appl. No. EP05813878.5-2214/Patent No. 1815559. Response to Supplementary European Search Report dated Feb. 6, 2009. Response date Dec. 10, 2009. 15 pages.
EP Appl. No. EP05813878.5-2214/Patent No. 1815559. Summons to Attend Oral Proceedings Pursuant to Rule 115(1) EPC on Oct. 28, 2010. Dated: Jun. 7, 2010. 12 pages.
Final Office Action (Mail Date: Oct. 25, 2011); U.S. Appl. No. 13/033,127, filed Feb. 23, 2011, Conf. No. 8230.
International Search Report and Written Opinion for PCT Application No. PCT/US2012/045669, mailed Jan. 21, 2013, 9 pages.
*John Mezzalingua Associates, Inc.* v. *PCT International*, Inc.; U.S. District Court Western District of Texas (San Antonio); Civil Docket for Case #: 5:09-cv-00410-WRF. No decision yet. Defendant/Counterclaimant PCT International, Inc.'s First Supplemental Answers and Objections to Plaintiff/Counterclaimant Defendant John Mezzalingua Associates, Inc. D/B/AS PPC's Amended Second Set of Interrogatories (Nos. 4-17). pp. 1-11.
*John Mezzalingua Associates, Inc.* v. *PCT International, Inc.*; U.S. District Court Western District of Texas (San Antonio); Civil Docket for Case #: 5:09-cv-00410-WRF. No decision yet. Defendant's Answer to Plaintif's First Amended Complaint, Affirmative Defenses and Counterclaims. pp. 1-53.
*John Mezzalingua Associates, Inc.* v. *PCT International, Inc.*; U.S. District Court Western District of Texas (San Antonio); Civil Docket for Case #: 5:09-cv-00410-WRF. No decision yet. Defendant's Response and Objections to Plaintaff's Amended Second Set of Interrogatories (Nos. 4-17). pp. 1-20.
*John Mezzalingua Associates, Inc.* v. *PCT International, Inc.*; U.S. District Court Western District of Texas (San Antonio); Civil Docket for Case #: 5:09-cv-00410-WRF. No decision yet. Expert Report of Barry Grossman (Redacted). 61 pages.
Notice of Allowance (Date Mailed: Aug. 5, 2011) for U.S. Appl. No. 12/418,103, filed Apr. 3, 2009.
Notice of Allowance (Date Mailed: Feb. 24, 2012) for U.S. Appl. No. 13/033,127, filed Feb. 23, 2011.
Notice of Allowance U.S. Appl. No. 12/397,087; Filing date Mar. 3, 2009.
Notice of Allowance U.S. Appl. No. 12/414,159; Filing date Mar. 30, 2009.
Notice of Allowance U.S. Appl. No. 12/427,843; Filing date Apr. 22, 2009.
Office Action (Mail Date Jun. 2, 2011) for U.S. Appl. No. 13/033,127, filed Feb. 23, 2011, Conf. No. 8230.
Office Action (Mail Date: Oct. 24, 2011); U.S. Appl. No. 12/633,792, filed Dec. 8, 2009.
*PCT International, Inc.* v. *John Mezzalingua Associates, Inc.*; U.S. District Court District of Delaware (Wilmington); Civil Docket for Case #: 1:10-cv-00059-LPS. No decision yet.
PCT/US2010/029587; International Filing Date Apr. 1, 2010. International Search Report and Written Opinion. Date of Mailing: Oct. 29, 2010.
PCT/US2010/029593; International Filing Date Apr. 1, 2010; International Search Report and Written Opinion; Date of Mailing: Nov. 12, 2010.
PCT/US2010/034870; International Filing Date May 14, 2010. International Search Report and Written Opinion. Date of Mailing: Nov. 30, 2010.
Response to Office Action for U.S. Appl. No. 12/568,160, filed Aug. 23, 2010, 3 pages.
Response to Office Action for U.S. Appl. No. 12/568,160, filed Mar. 7, 2011, 37 pages.
Statement of Substance of Interview, Terminal Disclaimer and Statement Under 37 CFR 3.73(b) for U.S. Appl. No. 12/568,179, filed Jun. 30, 2011, 5 pages.
Supplemental European Search Report. EP05813878. Feb. 6, 2009. 11 pages.

* cited by examiner

CABLE CONNECTOR WITH BIASING ELEMENT

CROSS-REFERENCE TO RELATED APPLICATIONS

This application is a continuation of U.S. application Ser. No. 13/023,102, filed Feb. 8, 2011, which is incorporated by reference herein in its entirety.

BACKGROUND

Embodiments disclosed herein relate to cable connectors and, in some cases, coaxial cable connectors. Such connectors are used to connect coaxial cables to various electronic devices, such as televisions, antennas, set-top boxes, satellite television receivers, etc. A coaxial cable connector may include a connector body for accommodating a coaxial cable, and a nut coupled to the body to mechanically attach the connector to an external device.

The Society of Cable Telecommunication Engineers (SCTE) provides values for the amount of torque recommended for connecting coaxial cable connectors to various external devices. Indeed, many cable television (CATV) providers, for example, also require installers to apply a torque of 25 to 30 in/lb to secure the fittings. The torque requirement prevents loss of signals (egress) or introduction of unwanted signals (ingress) between the two mating surfaces of the male and female connectors, known in the field as the reference plane.

DETAILED DESCRIPTION OF EXEMPLARY EMBODIMENTS

A large number of home coaxial cable installations are often done by "do-it yourself" laypersons who may not be familiar with SCTE torque standards. In these cases, the installer may tighten the coaxial cable connectors by hand instead of using a tool, which may result in the connectors not being properly seated, either upon initial installation, or after a period of use. Upon receiving a poor signal, the customer may call the CATV, MSO, satellite or telecommunication provider to request repair service. Such calls may create a cost for the CATV, MSO, satellite and telecommunication providers, who may send a repair technician to the customer's home.

Moreover, even when tightened according to the proper torque requirements, prior art connectors may tend, over time, to disconnect from the external device due to forces, such as vibrations, thermal expansion and contraction, etc. Specifically, the internally threaded nut that provides mechanical attachment of the connector to an external device may back-off or loosen from the threaded port connector of the external device over time. Once the connector becomes sufficiently loosened, electrical contact between the coaxial cable and the external device is broken, resulting in a poor connection.

Figure 1A:
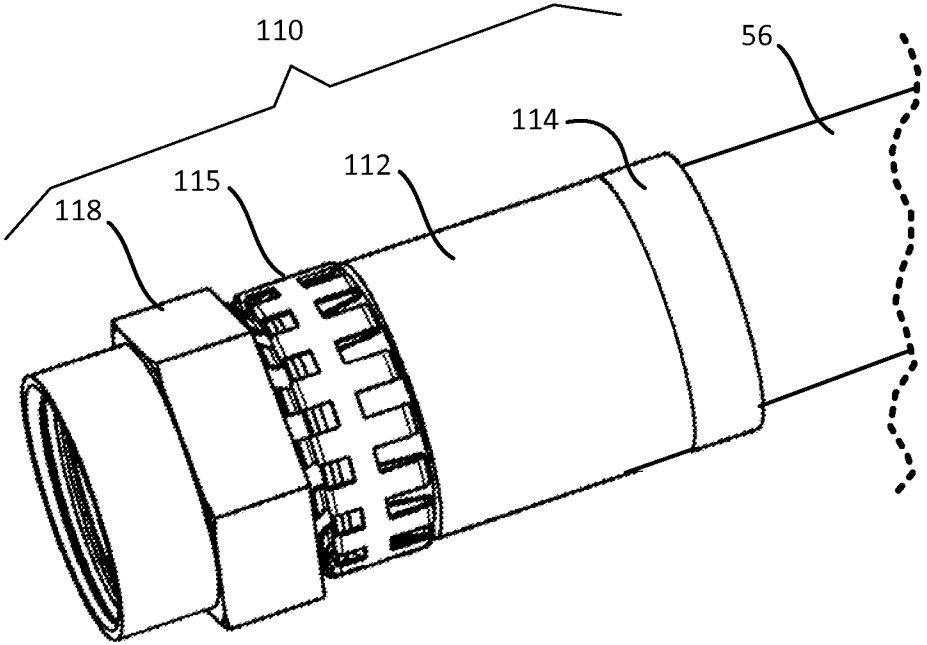
FIG. 1A is a perspective drawing of an exemplary coaxial cable connector in an assembled configuration with a biasing element.

FIG. 1A is a perspective drawing of an exemplary coaxial cable connector 110 in an assembled configuration and attached to the end of a coaxial cable 56. As illustrated in FIG. 1A, connector 110 may include a connector body 112, a locking sleeve 114, a rotatable nut 118, and a biasing element 115. In embodiments described below, connector 110 may be fastened to a port (not shown) of an electrical device (e.g. a television). Biasing element 115 may provide tension to reduce the chance of nut 118 becoming loose or backing off the port. Biasing element 115 may also reduce the chance of breaking the electrical continuity of the ground and/or shield connection between the port and the coaxial cable. As discussed below, biasing element 115 may be implemented in different ways.

Figure 1B:
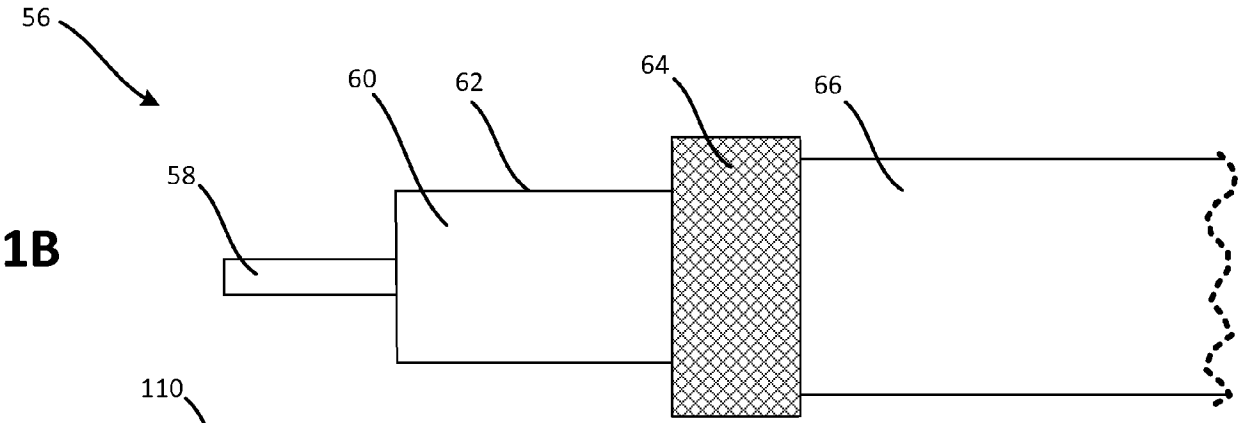
FIG. 1B is a drawing of a coaxial cable having been prepared to be inserted into and terminated by a coaxial cable connector, such as the coaxial cable connector of FIG. 1.

FIG. 1B is a drawing of coaxial cable 56 that has been prepared to be inserted into and terminated by a coaxial cable connector, such as connector 110. Coaxial cable 56 includes a center conductor 58 surrounded by a dielectric covering 60. Dielectric covering 60 is surrounded by a foil 62 and a metallic braid 64. Braid 64 is covered by an outer covering or jacket 66, which may be plastic or any other insulating material. To prepare coaxial cable 56 for use with a coaxial cable connector, cable 56 may be stripped using a wire stripper. As shown in FIG. 1B, a portion of center conductor 58 is exposed by removing a portion of the dielectric covering 60. Foil 62 may remain covering the dielectric layer 60. Metallic braid 64 may then be folded back over onto jacket 66 to overlap with jacket 66. The overlapping portion of metallic braid 64 may extend partially up the length of jacket 66.

Figure 1C:
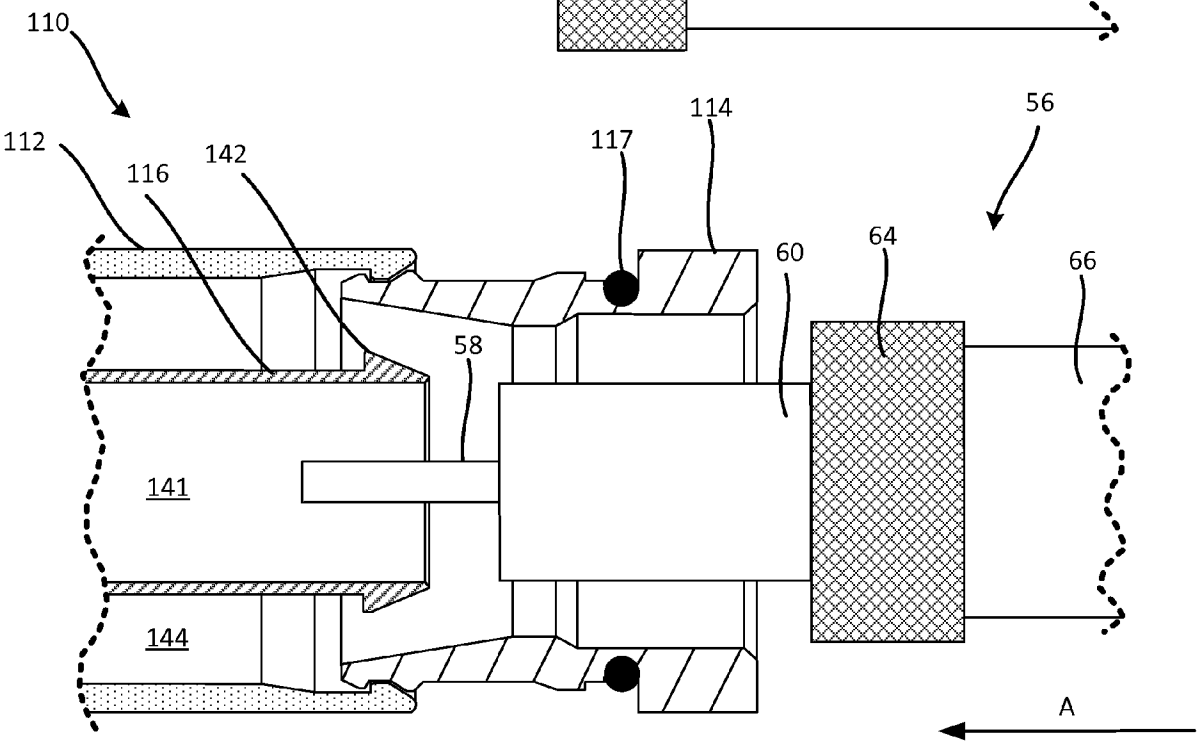
FIG. 1C is a cross-sectional drawing of an exemplary rear portion of the coaxial cable connector of FIG. 1A in an unattached configuration.

FIG. 1C is a cross-sectional drawing of an exemplary rear portion of coaxial cable connector 110 in an unattached configuration. As shown in FIG. 1C, in addition to body 112 and locking sleeve 114, connector 110 may include a post 116. FIG. 1C also shows a coaxial cable 56 being inserted into connector 110, e.g., moved forward in the direction of arrow A. Post 116 may include an annular barb 142 (e.g., a radially, outwardly extending ramped flange portion) that, as cable 56 is moved forward, is forced between dielectric layer 60 and braid 64. Barb 142 may also facilitate expansion of jacket 66 of cable 56. Locking sleeve 114 may then be moved forward (e.g., in direction A) into connector body 112 to clamp cable jacket 66 against barb 142, providing cable retention. In one embodiment, o-ring 117 may form a seal (e.g., a water-tight seal) between locking sleeve 114 and connector body 112.

Figure 1D:
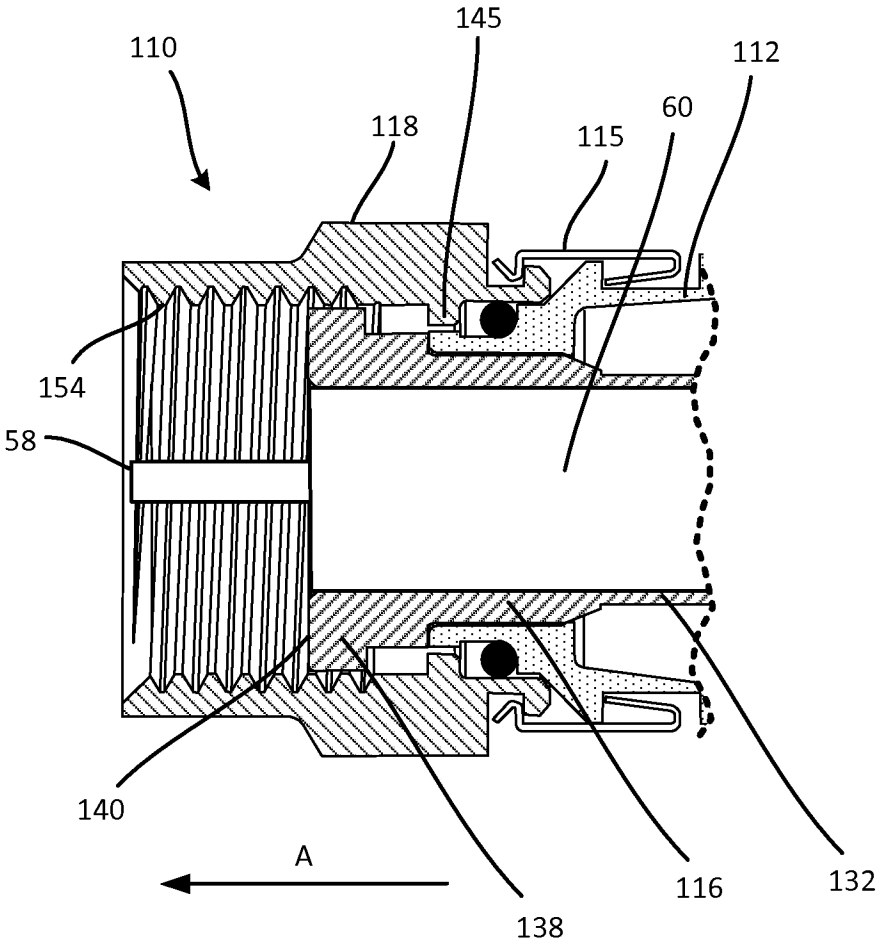
FIG. 1D is a cross-sectional drawings of an exemplary forward portion of the coaxial cable connector of FIG. 1A in which the coaxial cable of FIG. 1B has been secured.

FIG. 1D is a cross-sectional drawing of an exemplary forward portion of coaxial cable connector 110 in which coaxial cable 56 has been secured. FIG. 1D shows cross sections of rotatable nut 118, connector body 112, and tubular post 116 so as to reveal coaxial cable 56 (e.g., dielectric covering 60 and center conductor 58 of coaxial cable 56 are exposed for viewing). Post 116 may include a flanged portion 138 at its forward end. Post 116 may also include an annular tubular extension 132 that extends rearwardly. Post 116 defines a chamber that may receive center conductor 58 and dielectric covering 60 of an inserted coaxial cable 56. The external surface of post 116 may be secured into body 112 with an interference fit. Tubular extension 132 of post 116 may extend rearwardly within body 112. Post 116 may secure nut 118 by capturing an inwardly protruding flange 145 of nut 118 between body 112 and flanged portion 138 of post 116. In the configuration shown in FIG. 1D, nut 118 may be rotatably secured to post 116 and connector body 112. As shown in FIG. 1D, in one embodiment, an O-ring may be positioned between nut 118 and body 112. O-ring 46 may include resilient material (e.g., elastomeric material) to provide a seal (e.g., a water-resistant seal) between connector body 112, nut 118, and post 116.

Figure 1E:
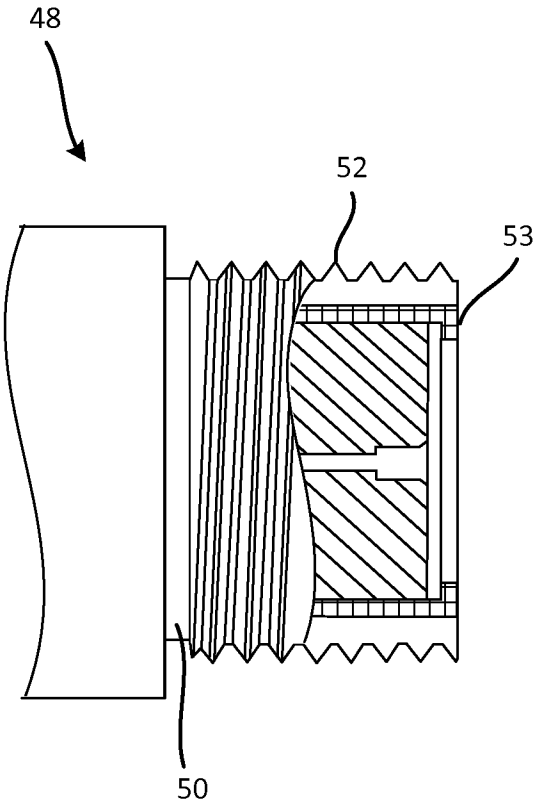
FIG. 1E is a cross-sectional drawing of a port connector to which the coaxial cable connector of FIG. 1A may be connected.

Once coaxial cable 56 is secured in connector 110, connector 110 may then be attached to a port connector of an external device. FIG. 1E shows a cross-sectional drawing of a port connector 48 to which connector 110 may be connected. As illustrated in FIG. 1E, port connector 48 may include a substantially cylindrical body 50 having external threads 52 that match internal threads 154 of rotatable nut 118. As discussed in further detail below, rotatable threaded engagement between threads 154 of nut 118 and threads 52 of port connector 48 may cause rearward surface 53 of port connector 48 to engage front surface 140 of flange 138 of post 116. The conductive nature of post 116 may provide an electrical path from surface 53 of port connector 48 to braid 64 around coaxial cable 56, providing proper grounding and shielding. As also discussed in more detail below, biasing element 115 may act to provide tension between external threads 52 and internal threads 154, reducing the likelihood that connector 110 will unintentionally back-off of port 48.

Figure 2B:
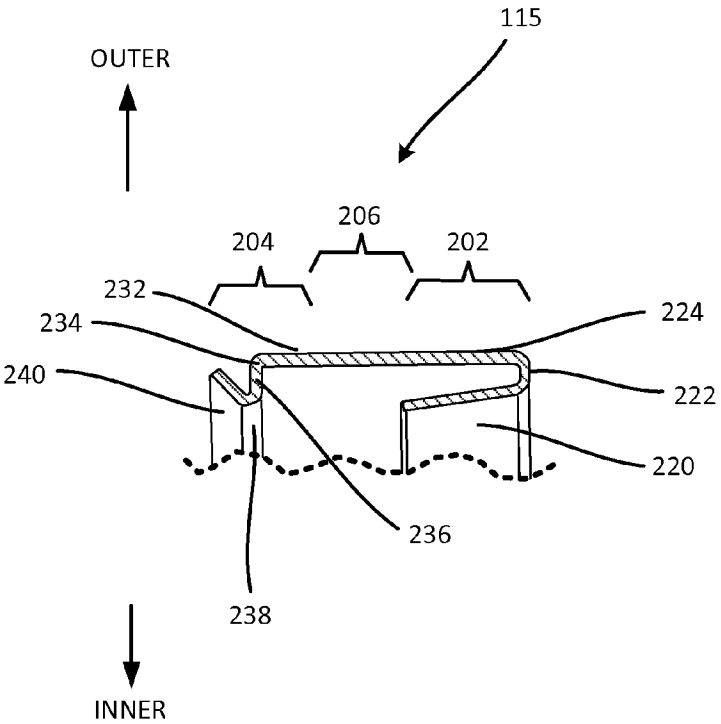
FIG. 2B is a cross-sectional drawing of the exemplary biasing element of FIG. 2A.
Figure 2A:
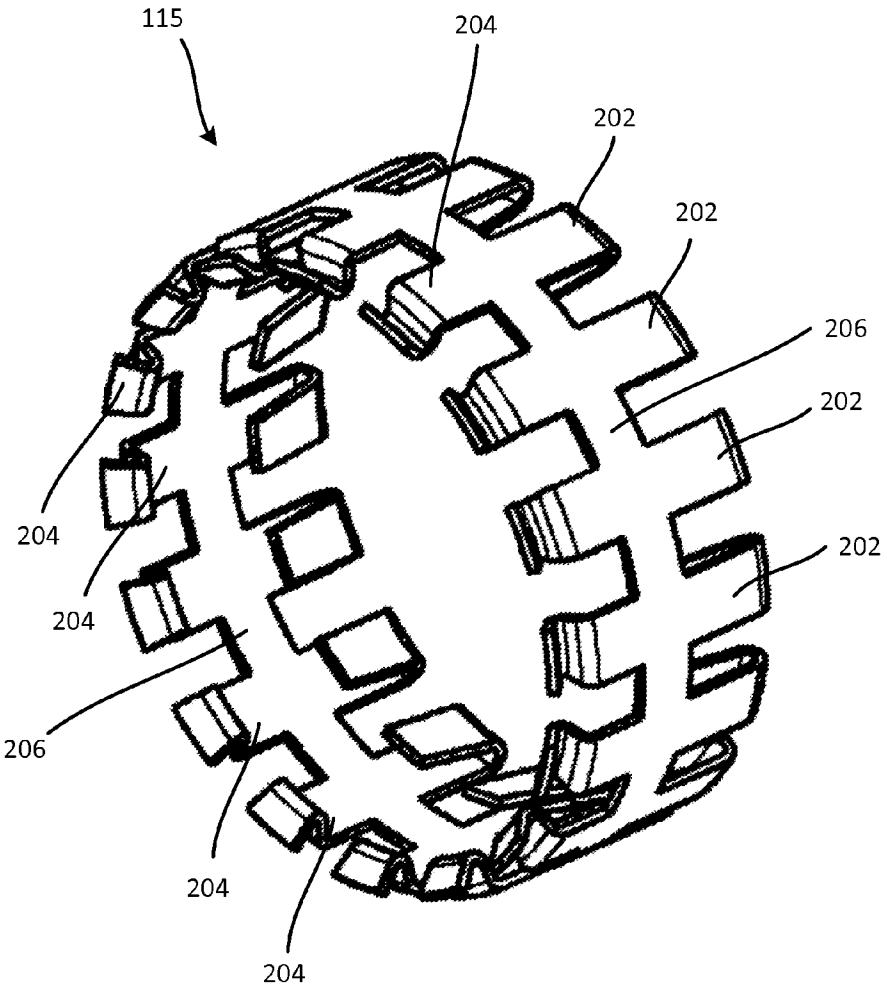
FIG. 2A is a perspective drawing of the exemplary biasing element of FIG. 1A.
Figures 3, 4:
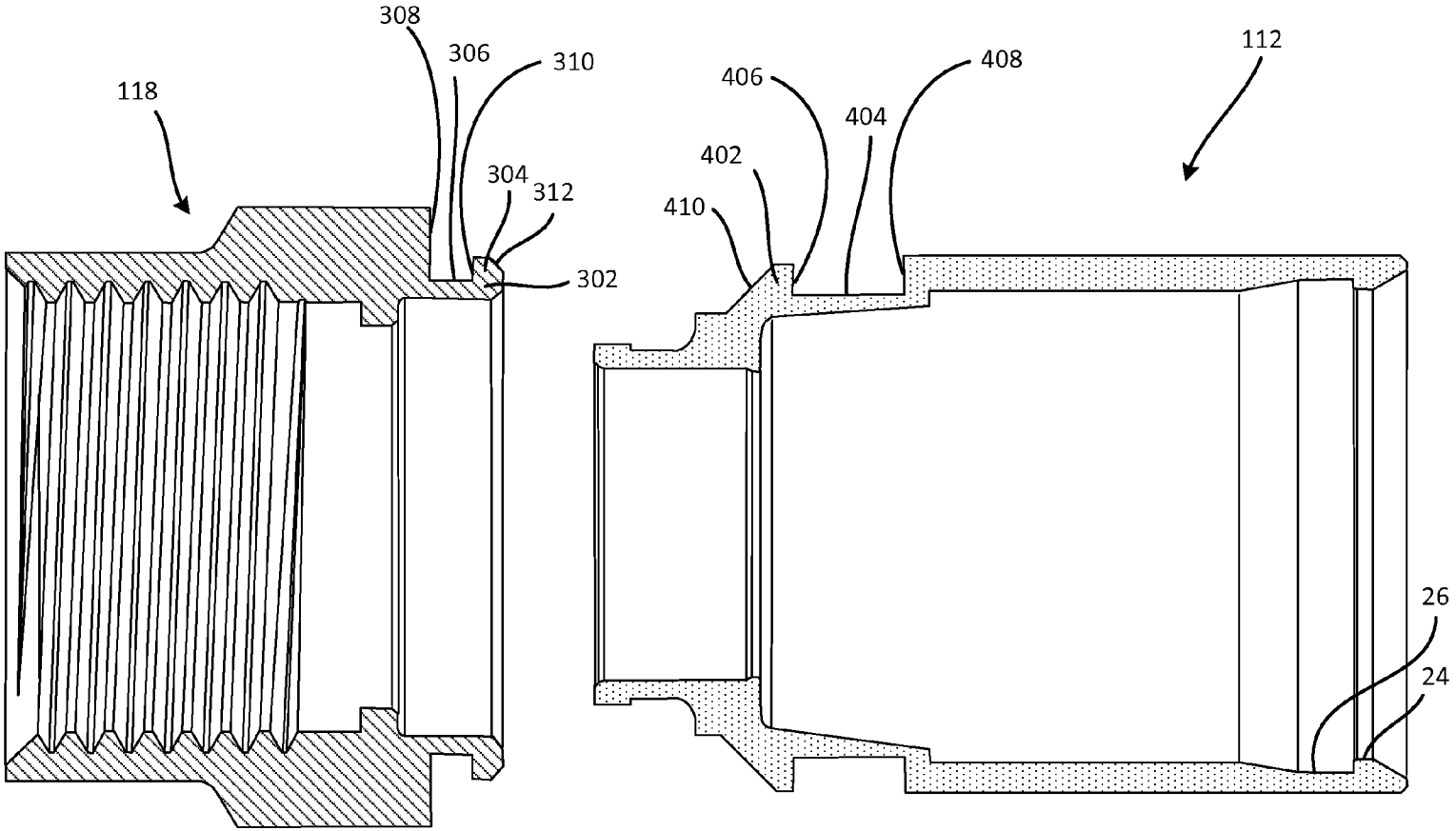
FIG. 3 is a cross-sectional drawing of the exemplary nut of the connector of FIG. 1A.
FIG. 4 is a cross-sectional drawing of the exemplary body of the connector of FIG. 1A.

Biasing element 115 is described in more detail with respect to FIGS. 2A and 2B, nut 118 is described in more detail with respect to FIG. 3, and body 112 is described in more detail with respect to FIG. 4. The cooperation between nut 118, biasing element 115, and body 112 is described in more detail with respect to FIGS. 5A through 8B.

FIG. 2A is a perspective drawing of exemplary biasing element 115. As shown, biasing element 115 may include a group of rearward fingers 202 (individually, "rearward finger 202"), a group of forward fingers 204 (individually, "forward finger 204"), and an annular portion 206. Annular portion 206 may connect and support rearward fingers 202 and forward fingers 204. Biasing element 115 may be made from plastic, metal, or any suitable material or combination of materials. In one embodiment, biasing element 115, nut 118, and body 112 are made of a conductive material (e.g., metal) to enhance conductivity between port connector 48 and post 116.

FIG. 2B is a cross-sectional drawing of exemplary biasing element 115 of FIG. 2A, depicting rearward finger 202 and forward finger 204 in additional detail. As shown, rearward finger 202 may include an inner member 220, an outer member 224, and/or an elbow 222 in between members 220 and 224. In one embodiment, elbow 222 may act as a spring and, in this embodiment, FIG. 2B shows inner member 220, outer member 224, and elbow 222 in a rest state. In this state, elbow 222 may provide a tension force to return rearward finger 202 to its rest state when inner member 220 and/or outer member 224 are moved relative to each other.

As shown in FIG. 2B, forward finger 204 includes a first member 232 and a second member 236 with an angled portion 234 in between. Forward finger 204 may also include a third member 240 with an elbow 238 in between third member 240 and second member 236. Angled portion 234 may act as a spring and, in this embodiment, FIG. 2B shows first member 232, angled portion 234, and second member 236 in a rest state. In this rest state, angled portion 234 may provide a tension force to return forward finger 204 to its rest state when first member 232 and/or second member 236 are moved relative to each other. Further, elbow 238 may also act as a spring and, in this embodiment, FIG. 2B shows second member 236, elbow 238, and third member 240 in a rest state. In this rest state, elbow 238 may provide a tension force to return forward finger 204 to its rest state when second member 236 and/or third member 240 are moved relative to each other.

In addition, annular portion 206, outer member 224, and/or first portion 232 may also act as a spring. In this embodiment, FIG. 2B shows annular portion 206, outer member 224, and first portion 232 in a rest state. When annular portion 206, outer member 224, and first portion 232 are moved relative to each other, for example, the spring nature of these components may create a tension force to return them to a rest state.

FIG. 3 is a cross-sectional drawing of exemplary nut 118 of FIGS. 1A and 1D. Nut 118 may provide for mechanical attachment of connector 110 to an external device, e.g., port connector 48, via a threaded relationship. Nut 118 may include any type of attaching mechanisms, including a hex nut, a knurled nut, a wing nut, or any other known attaching means. As shown, nut 118 includes a rear annular member 302 having an outward flange 304. Nut 118 may be made from plastic, metal, or any suitable material or combination of materials. Annular member 302 and outward flange 304 form an annular recess 306. Annular recess 306 includes a forward wall 308 and a rear wall 310. Outward flange 304 may include a rear-facing beveled edge 312.

FIG. 4 is a cross-sectional drawing of connector body 112. Connector body 112 may include an elongated, cylindrical member, which can be made from plastic, metal, or any suitable material or combination of materials. Connector body 112 may include a cable receiving end that includes an inner sleeve-engagement surface 24 and a groove or recess 26. Opposite the cable-receiving end, connector body 112 may include an annular member (or flange) 402. Annular member 402 may form an annular recess 404 with the rest of connector body 112. As shown, recess 404 includes a forward wall 406 and a rear wall 408. In one embodiment, recess 404 includes forward wall 406, but no rear wall. That is, recess 404 is defined by annular member 402. Annular member 402 may also include a forward-facing bevel 410 leading up to recess 404. The cooperation of nut 118, body 112, and biasing element 115 is described with respect to FIGS. 5A through 8B below.

Figure 5A:
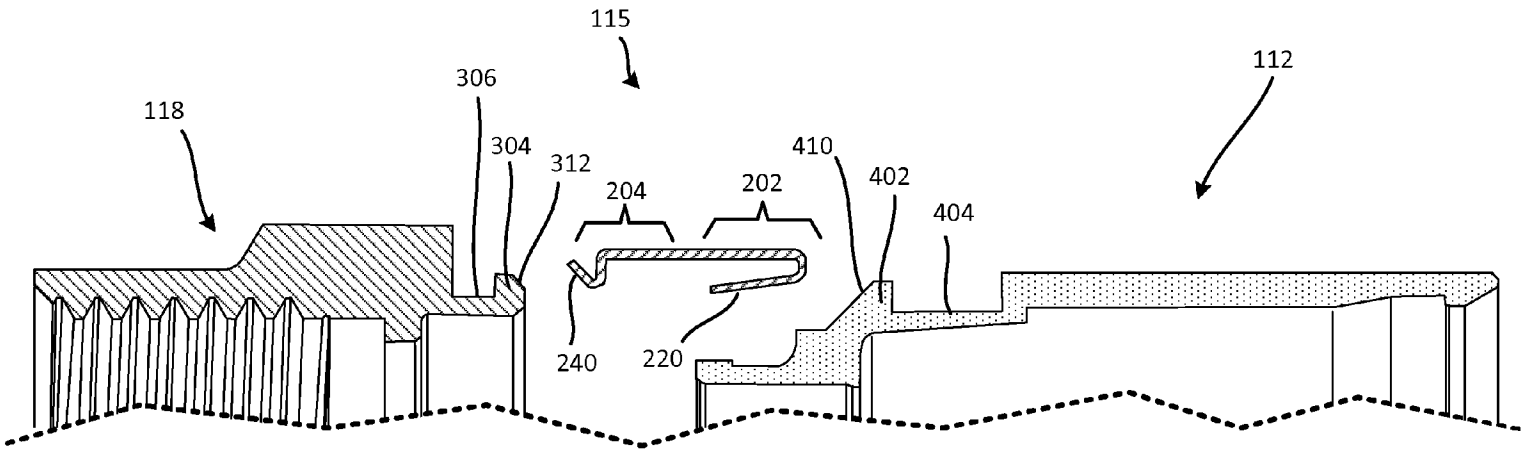
FIG. 5A is a cross-sectional drawing of the nut, body, and biasing element prior to assembly of the connector of FIG. 1A.
Figure 5B:
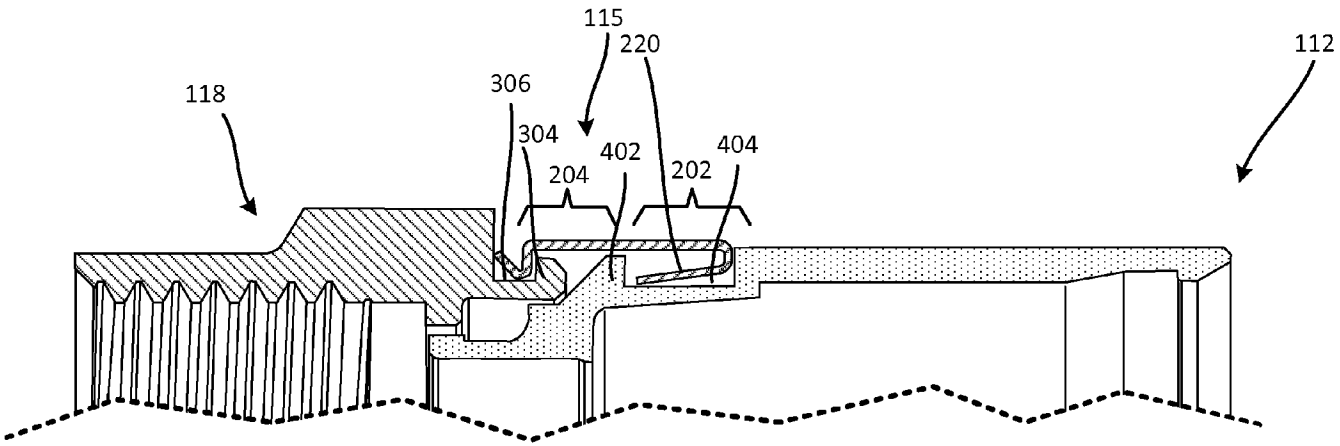
FIG. 5B is a cross-sectional drawing of the nut, body, and biasing element subsequent to assembly of the connector of FIG. 1A.

FIG. 5A is a cross-sectional drawing of nut 118, body 112, and biasing element 115 prior to assembly. FIG. 5B is a cross-sectional drawing of nut 118, body 112, and biasing element 115 after assembly. For simplicity, other components of connector 110 are omitted from FIGS. 5A and 5B. As shown, the angle of bevel 312 of nut 118 and the angle of third member 240 of biasing element 115 may complement each other such that when biasing element 115 and nut 118 are moved toward each other, forward finger 204 may snap over annular flange 304 and come to rest in recess 306 of nut 118 (as shown in FIG. 5B). Likewise, the angle of bevel 410 of body 112 and the angle of inner member 220 may complement each other such that when biasing element 115 and body 112 move toward each other, rearward finger 202 may snap over annular portion 402 and come to rest in annular recess 404 of body 112 (as shown in FIG. 5B). The spring nature of biasing element 115, as described above, may facilitate the movement of forward finger 204 over annular flange 304 of nut 118 and the movement of rearward finger 202 over annular portion 402 of body 112.

Figure 6A:
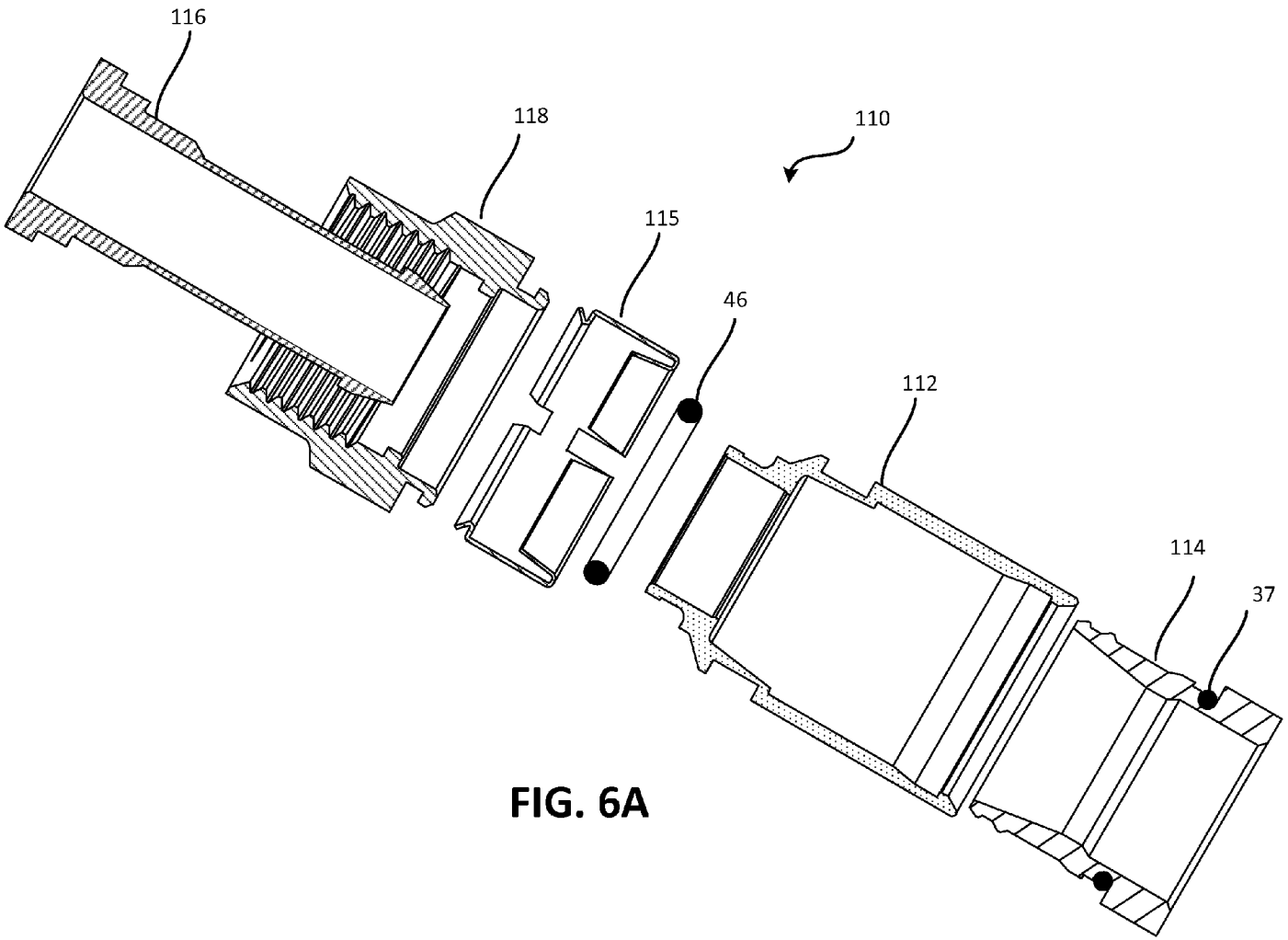
FIG. 6A is an exploded cross-sectional drawing of the unassembled components of the connector of FIG. 1A.

FIG. 6A is an exploded cross-sectional drawing of unassembled components of connector 110. As shown in FIG. 6A, connector 110 may include nut 118, body 112, locking sleeve 114, biasing element 115, post 116, an O-ring 46, and seal 37.

Figure 6B:
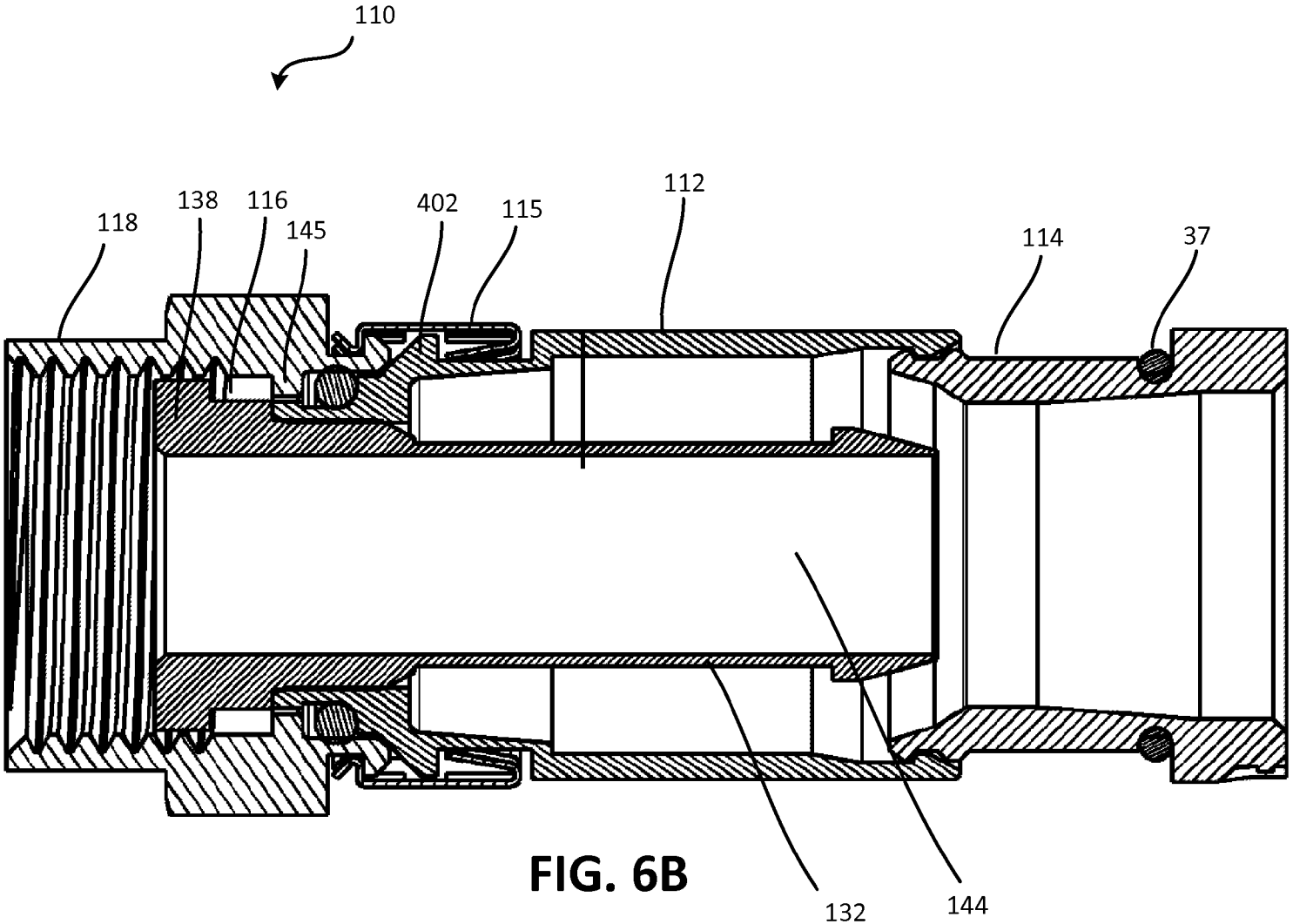
FIG. 6B is a cross-sectional drawing of the components of the connector of FIG. 1A in an assembled configuration.

In addition to body 112, biasing element 115, and nut 118 being assembled as shown in FIG. 5B, post 116 may be press fit into body 112, and locking sleeve 114 may be snapped onto the end of body 112, resulting in an assembled configuration shown in FIG. 6B and discussed above with respect to FIGS. 1A through 1E.

FIG. 6B is a cross-sectional view of connector 110 in an assembled configuration. As illustrated in FIG. 6B, the external surface of post 116 may be secured into body 112 with an interference fit. Further, post 116 may secure nut 118 by capturing flange 145 of nut 118 between radially extending flange 402 of body 112 and flanged base portion 138 of post 116. In the configuration shown in FIG. 6B, nut 118 may be rotatably secured to post 116 and connector body 112. Tubular extension 132 of post 116 may extend rearwardly within body 112 and terminate adjacent the rearward end of connector body 112.

Figure 7A:
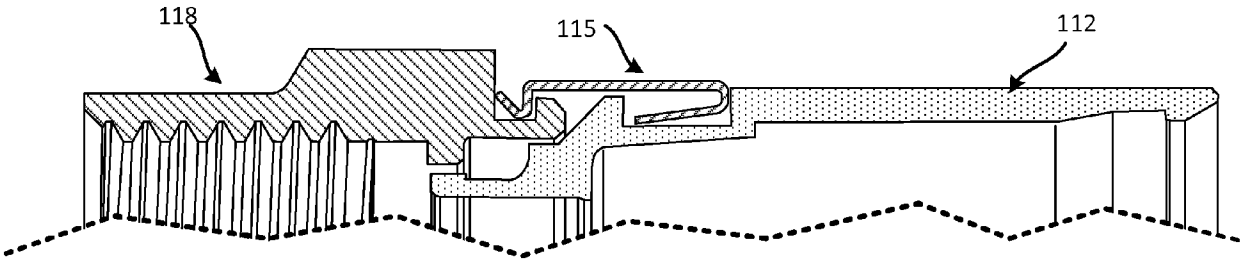
FIG. 7A is a cross-sectional drawing of the nut, body, and biasing element subsequent to assembly of the connector of FIG. 1A, wherein the biasing element is in a rest state.
Figure 7C:
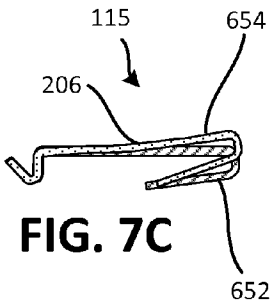
FIG. 7C is a cross-sectional drawing of the biasing element of the connector of FIG. 1A in a biased state and a rest state.
Figure 7B:
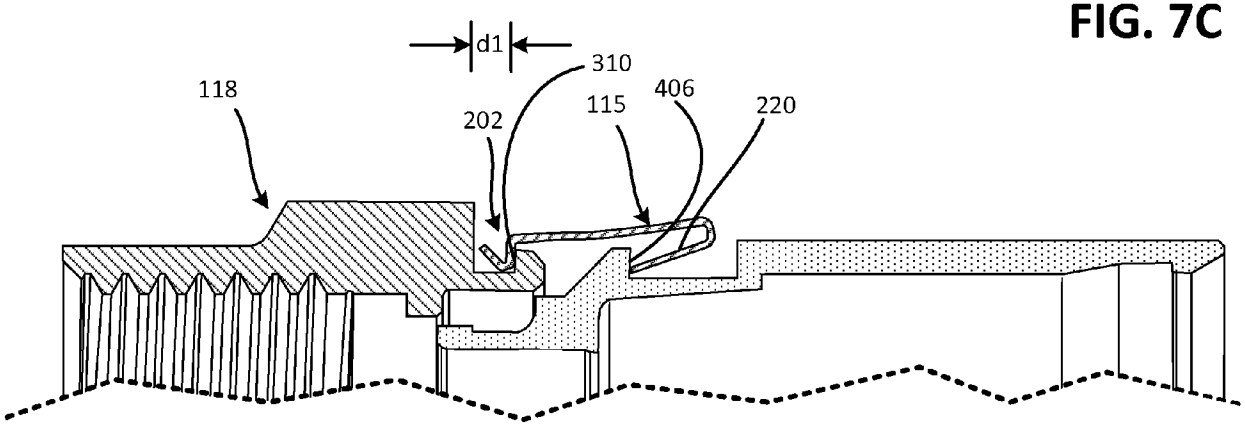
FIG. 7B is a cross-sectional drawing of the nut, body, and biasing element subsequent to assembly of the connector of FIG. 1A, wherein the biasing element is in a biased state.

FIG. 7A is a cross-sectional view of nut 118, body 112, and biasing element 115 in an assembled position, similar to the position shown in FIG. 5A. Again, other elements of connector 110 are omitted for ease of illustration. For example, after assembly, nut 118 may move a distance d1 in the forward direction relative to body 112, as shown in FIG. 7B relative to FIG. 7A. In this case, rear wall 310 of nut 118 may contact second member 236 of biasing element 115. Likewise, inner member 220 may contact front wall 406 of body 112. The displacement of nut 118 may flex biasing element 115 from its rest position (shown in FIG. 7A) to a biased position (shown in FIG. 7B). Biasing element 115 provides a tension force on nut 118 in the rearward direction and a tension force on body 112 in the forward direction. For ease of understanding, FIG. 7C is a cross-sectional drawing of biasing element 115 in a rest state 652 and a biased state 654. In the embodiment of FIG. 7C, in biased state 654, rearward finger 202 extends outward beyond annular portion 206. That is, in this embodiment, the outer diameter biasing element 115 increases from unbiased state 652 to biased state 654. In other embodiments, one of which is discussed below, the outer diameter of the biasing element does not increase as it moves from an unbiased state to a biased state.

Figure 8A:
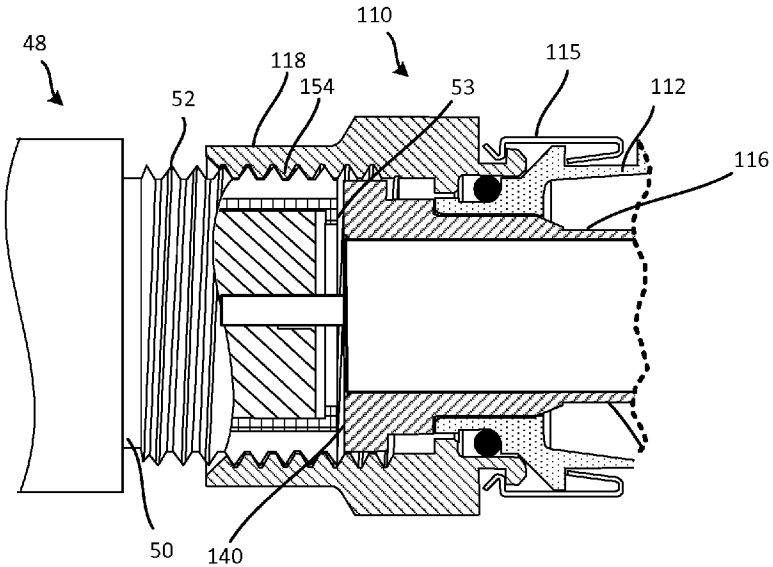
FIG. 8A is a cross-sectional drawing of the connector of FIG. 1A connected to a port, wherein the biasing element is in a rest state.

FIG. 8A is a cross-sectional drawing of the front portion of assembled connector 110 coupled to port connector 48. As shown, nut 118 has been rotated such that inner threads 154 of nut 118 engage outer threads 52 of port connector 48 to bring surface 53 of port connector 48 into contact with or near front surface 140 of flange 138 of post 116. In the position shown in FIG. 8A, biasing element 115 is in a rest state and not providing any tension force, for example. Thus, the positions of nut 118, body 112, and biasing element 115 relative to each other as shown in FIG. 8A is similar to that described above with respect to FIGS. 5B and 7A.

Figure 8B:
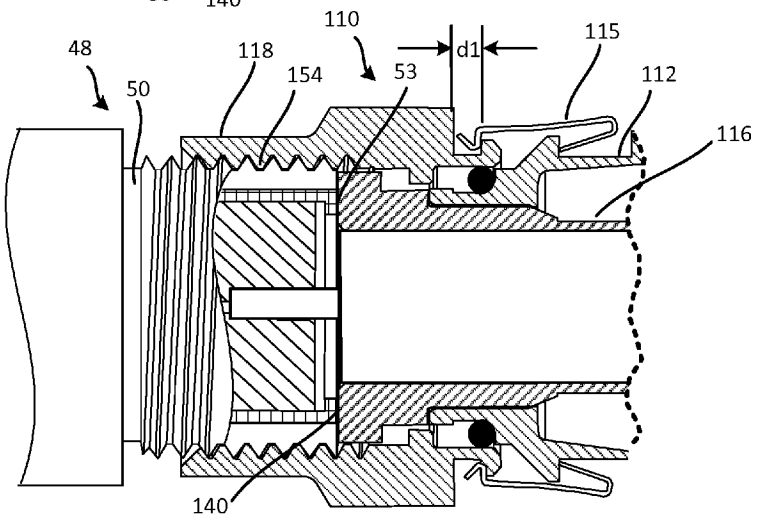
FIG. 8B is a cross-sectional drawing of the connector of FIG. 1A connected to a port, wherein the biasing element is in a biased state.

As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 118 may move nut 118 forward with respect to body 112 and post 116. As such, biasing element 115 may move to a biased state as it captures kinetic energy of the rotation of nut 118 and stores the energy as potential energy. In this biased state, the positions of nut 118, body 112, and biasing element 115 relative to each other as shown in FIG. 8B is similar to that described above with respect to FIG. 7B. Biasing element 115 provides a load force on nut 118 in the rearward direction and a load force on body 112 in the forward direction. These forces are transferred to threads 52 and 154 (e.g., by virtue of rear surface 53 being in contact with post 116, which in this embodiment is fixed relative to body 112). Tension between threads 52 and 154 may decrease the likelihood that nut 118 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 118 becomes partially loosened (e.g., by a half or full rotation), biasing element 115 may maintain pressure between surface 53 of port 48 and front surface 140 of post 116, which may help maintain electrical continuity and shielding.

Figure 9C:
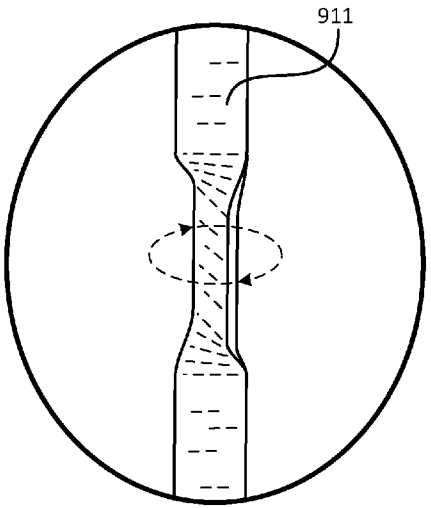
FIG. 9C is a drawing of the exemplary bridge portion of the biasing element of FIG. 9A.
Figure 9B:
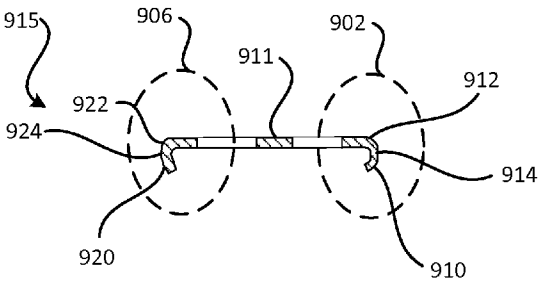
FIG. 9B is a cross-sectional drawing of the exemplary biasing element of FIG. 9A.
Figure 9A:
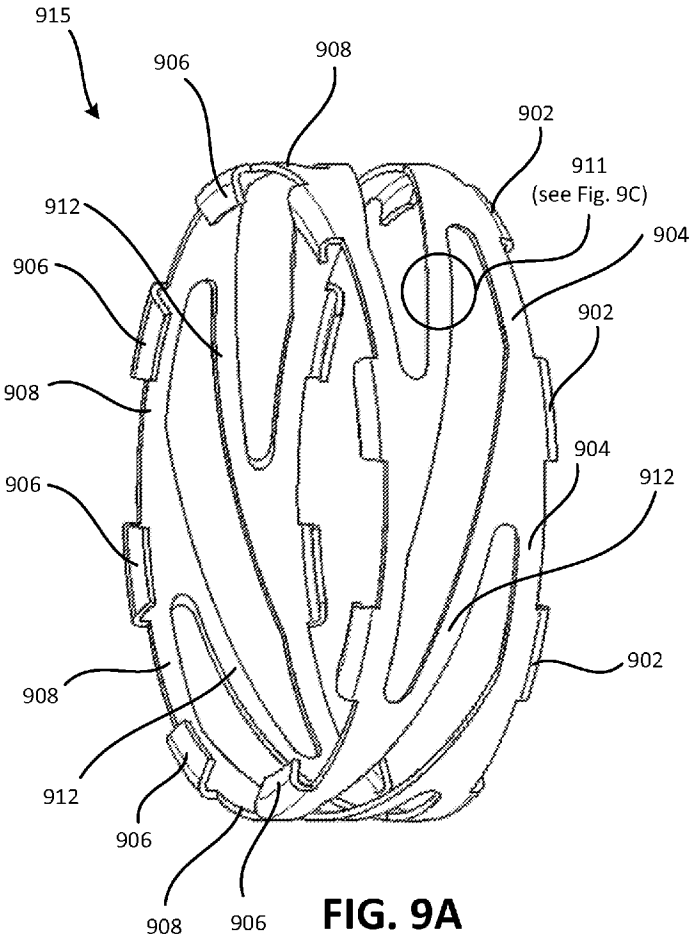
FIG. 9A is a perspective drawing of an exemplary biasing element in another embodiment.

FIG. 9A is a perspective drawing of a biasing element 915 in an alternative embodiment. Connector 110 of FIG. 1A, for example, may include biasing element 915 rather than biasing element 115 as shown. Biasing element 915 may include rearward fingers 902 (individually, "rearward finger 902"), a rearward annular support 904, forward fingers 906 (individually, "forward finger 906"), and a rearward annular support 908. A bridge portion 911 may span between rearward annular support 904 and forward annular support 908. Biasing element 915 may be made from plastic, metal, or any suitable material or combination of materials. In one embodiment, biasing element 915, nut 118, and body 112 are made of a conductive material (e.g., metal) to enhance conductivity between port connector 48 and post 116.

FIG. 9B is a cross-sectional drawing of biasing element 915. As shown, rearward finger 902 includes an inner portion 910, an outer portion 912, and an elbow portion 914 between the two. In one embodiment, elbow portion 914 may act as a spring and, in this embodiment, FIG. 9B shows inner portion 910, outer portion 912, and elbow portion 914 in a rest state. Elbow portion 914 may provide a tension force to return rearward finger 902 to its rest state when inner portion 910, outer portion 912, and/or elbow portion 914 are moved relative to each other.

As shown, forward finger 906 includes an inner portion 920, an outer portion 922, and an elbow portion 924 in between the two. In one embodiment, elbow portion 924 may act as a spring and, in this embodiment, FIG. 9B shows inner portion 920, outer portion 922, and elbow portion 924 in a rest state. In this embodiment, elbow portion 924 may provide a tension force to return forward finger 906 to its rest state when inner portion 920, outer portion 922, and/or elbow portion 924 are moved relative to each other.

Bridge portion 911 spans between forward annular support 904 and rearward annular support 908. In one embodiment, bridge portion 911 may act as a spring and, in this embodiment, FIGS. 9A and 9B show biasing element 915 in a rest state. Bridge portion 911 may act to return biasing element 915 to its rest state when, for example, rearward annular support 904 and forward annular support 908 move away from each other or move toward each other. FIG. 9C is a drawing of bridge portion 911 in one embodiment. In this embodiment, bridge portion 911 is twisted, e.g., by ninety degrees. This embodiment may allow for more spring in bridge portion 911, for example.

Figure 10A:
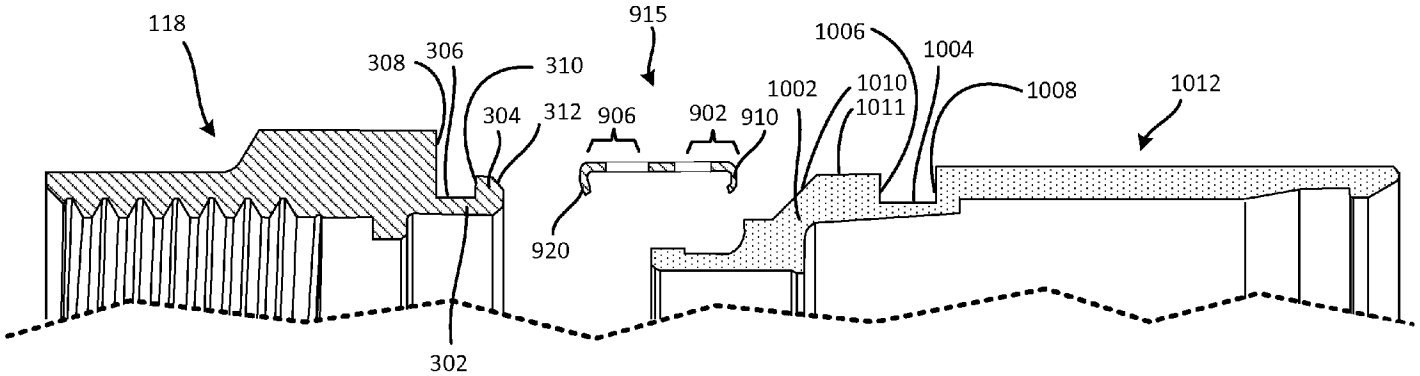
FIG. 10A is a cross-sectional drawing of an exemplary nut and connector body including the biasing element of FIG. 9A prior to assembly.

FIG. 10A is a cross-sectional drawing of nut 118 and a connector body 1012 in an other embodiment, including biasing element 915. Nut 118, as shown in FIG. 10, includes annular recess 306 having a front wall 308 and a rear wall 310. Nut 118 includes an annular member 302 having an outwardly protruding flange 304 with a beveled edge 312. Connector body 1012, like body 112, may include an elongated, cylindrical member, which can be made from plastic, metal, or any suitable material or combination of materials. Opposite a cable-receiving end, connector body 1012 may include an annular member (or flange) 1002. Annular member 1002 may form an annular recess 1004 between annular member 1002 and the rest of connector body 1012. As shown, recess 1004 includes a forward wall 1006 and a rear wall 1008. In one embodiment, recess 1004 includes forward wall 1006, but no rear wall. That is, recess 1004 is defined by annular member 1002. Annular member 1002 may also include a forward-facing bevel 1010 leading up to recess 1004.

Figure 10B:
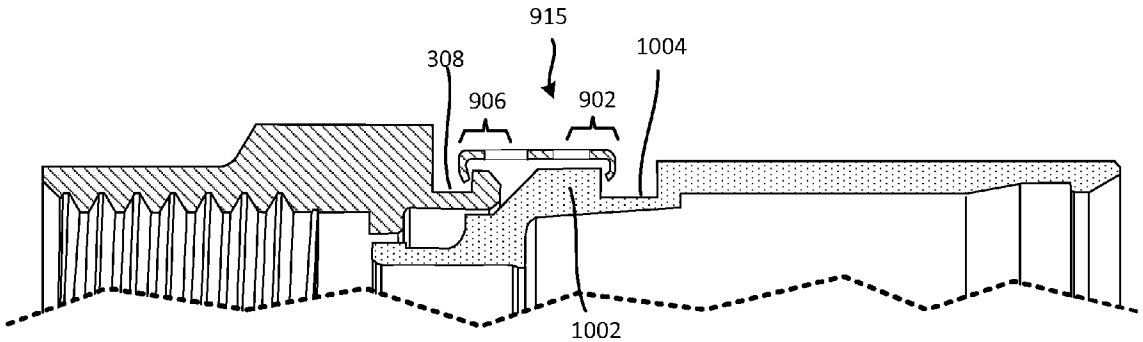
FIG. 10B is a cross-sectional drawing of the exemplary nut and connector body of FIG. 10A including the biasing element of FIG. 9A in an assembled configuration.

As shown in FIG. 10A, the angle of bevel 312 of nut 118 and the angle of inner portion 920 of biasing element 915 may complement each other such that when biasing element 915 and nut 118 are moved toward each other, forward finger 906 may snap over annular flange 304 and come to rest in recess 306 of nut 118 (as shown in FIG. 10B). Likewise, the angle of bevel 1010 of body 1012 and the angle of inner portion 910 may complement each other such that when biasing element 915 and body 1012 move toward each other, rearward finger 902 may snap over annular portion 1002 and come to rest in annular recess 1004 of body 1012 (as shown in FIG. 10B). The spring nature of biasing element 915, as described above, may facilitate the movement of forward finger 906 over annular flange 304 of nut 118 and the movement of rearward finger 902 over annular portion 1002 of body 1012.

Figure 11A:
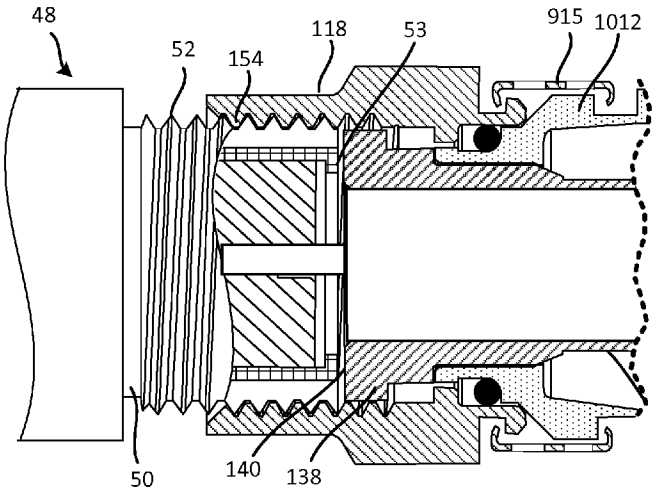
FIG. 11A is a cross-sectional drawing of the connector of FIG. 10A, including the biasing element of FIG. 9A, attached to a port, wherein the biasing element is in a rest state.
Figure 11B:
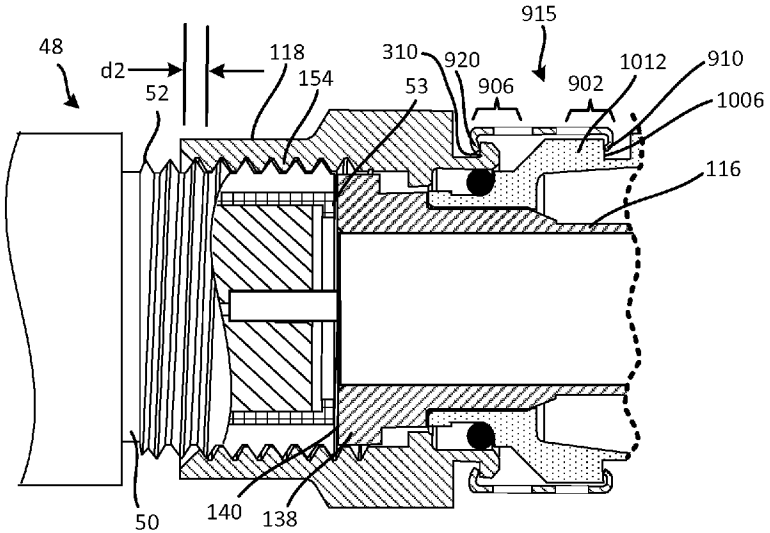
FIG. 11B is a cross-sectional drawing of the connector of FIG. 10A, including the biasing element of FIG. 9A, attached to a port, wherein the biasing element is in a biased state.

FIGS. 11A and 11B are cross-sectional drawings of port 48 coupled to a connector that incorporates biasing element 915, post 116, body 1012, and nut 118. FIG. 11A shows biasing element 915 in an unbiased state, while FIG. 11B shows biasing element 915 in a biased state. As shown, nut 118 has been rotated such that inner threads 154 of nut 118 engage outer threads 52 of port connector 48 to bring surface 53 of port connector 48 into contact with or near front surface 140 of flange 138 of post 116. In the position shown in FIG. 11A, biasing element 915 is in a rest state and not providing any tension force, for example.

As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 118 may move nut 118 forward with respect to body 1012 and post 116. As shown in FIG. 11B as compared to FIG. 11A, nut 118 may move a distance d2 in the forward direction relative to body 1012. In this case, rear wall 310 of nut 118 may contact inner portion 920 of forward finger 906 of biasing element 915. Likewise, inner portion 910 of rear finger 902 may contact front wall 1006 of body 1012. The displacement of nut 118 may flex biasing element 915 from its rest position (shown in FIG. 11A) to a biased position (shown in FIG. 11B). Biasing element 915 provides a tension force on nut 118 in the rearward direction and a tension force on body 1012 in the forward direction.

As biasing element 915 moves to a biased state, it captures kinetic energy of the rotation of nut 118 and stores the energy as potential energy. Biasing element 915 provides a load force on nut 118 in the rearward direction and a load force on body 1012 in the forward direction. These forces are transferred to threads 52 and 154 (e.g., by virtue of rear surface 53 being in contact with post 116, which in this embodiment is fixed relative to body 1012). Tension between threads 52 and 154 may decrease the likelihood that nut 118 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 118 becomes partially loosened (e.g., by a half or full rotation), biasing element 915 may maintain pressure between surface 53 of port 48 and front surface 140 of post 116, which may help maintain electrical continuity and shielding.

Figure 12B:
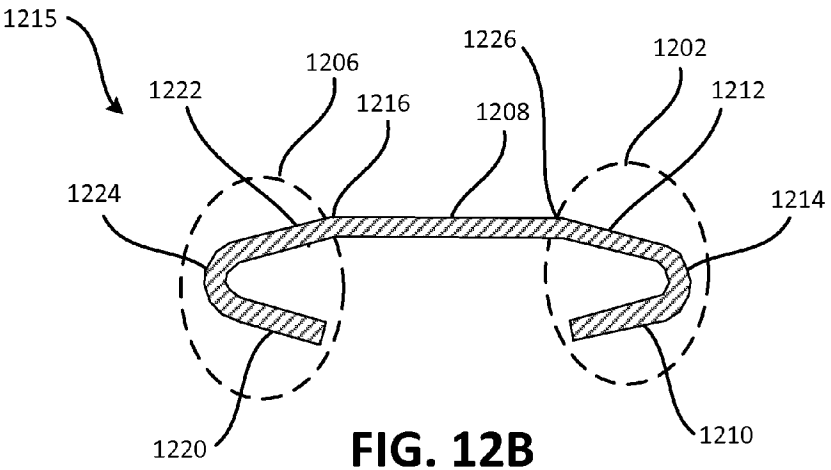
FIG. 12B is a cross-sectional drawing of the exemplary biasing element of FIG. 12A.
Figure 12C:
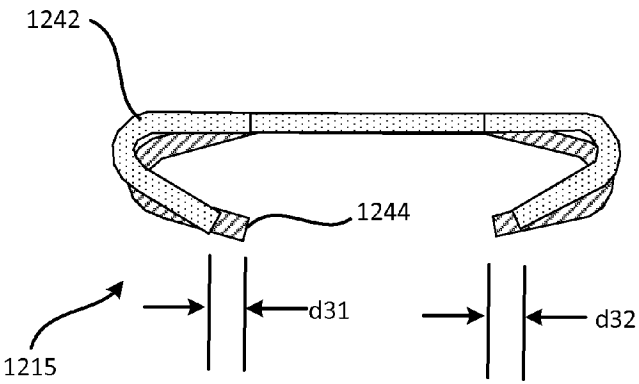
FIG. 12C is a cross-sectional drawing of the biasing element of FIG. 12A in a biased state and a rest state.
Figure 12A:
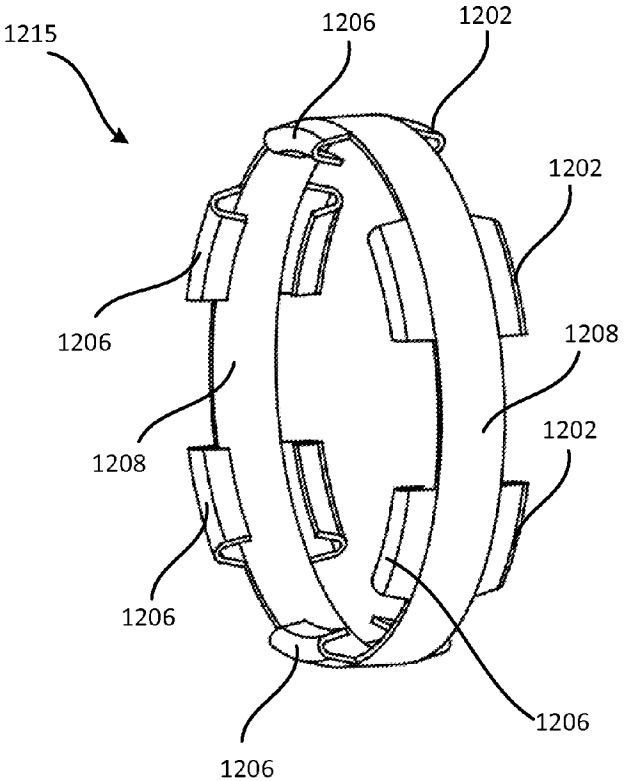
FIG. 12A is a perspective drawing of a biasing element in another embodiment.
Figure 14:
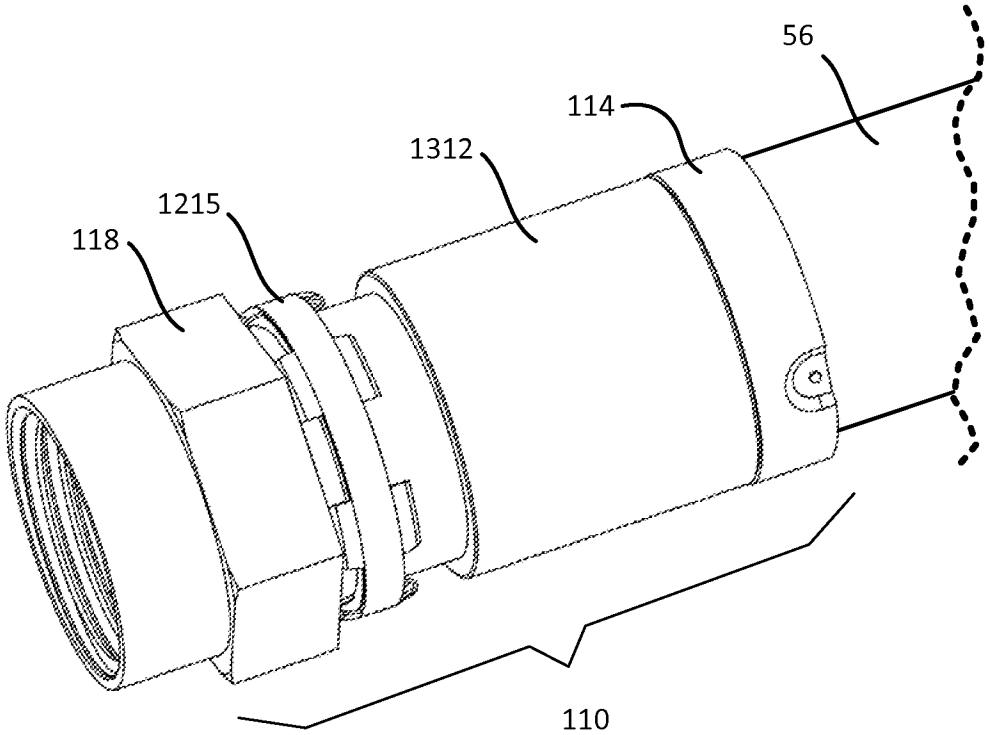
FIG. 14 is a perspective drawing of an exemplary coaxial cable connector in an assembled configuration with the exemplary biasing element of FIG. 12A.

FIG. 12A is a perspective drawing of a biasing element 1215 in an alternative embodiment. Connector 110 of FIG. 1A, for example, may include biasing element 1215 rather than biasing element 115 as shown. FIG. 14 is a drawing of a perspective view of a connector with biasing element 2115. Biasing element 1215 may include rearward fingers 1202 (individually, "rearward finger 1202"), forward fingers 1206 (individually, "forward finger 1206"), and an annular support 1208. Annular support 1208 may provide support for forward fingers 1206 and rearward fingers 1202. Biasing element 1215 may be made from plastic, metal, or any suitable material or combination of materials. In one embodiment, biasing element 1215, nut 118, and the body are made of conductive material (e.g., metal) to enhance conductivity between port connector 48 and post 116.

FIG. 12B is a cross-sectional drawing of biasing element 1215. As shown, rearward finger 1202 includes an inner portion 1210, an outer portion 1212, and an elbow portion 1214 between the two. In one embodiment, elbow portion 1214 may act as a spring and, in this embodiment, FIG. 12B shows inner portion 1210, outer portion 1212, and elbow portion 1214 in a rest state. In this state, elbow portion 1214 may provide a tension force to return rearward finger 1202 to its rest state when inner portion 1210 and/or outer portion 1212 are moved relative to each other.

As shown, forward finger 1206 includes an inner portion 1220, an outer portion 1222, and an elbow portion 1224 between the two. In one embodiment, elbow portion 1224 may act as a spring and, in this embodiment, FIG. 12B shows inner portion 1220, outer portion 1222, and elbow portion 1224 in a rest state. In this embodiment, elbow portion 1224 may provide a tension force to return forward finger 1206 to its rest state when inner portion 1220 and/or outer portion 1222 are moved relative to each other.

Further, biasing element 1215 may include a bend 1216 between forward finger 1206 and annular support 1208. Biasing element 1215 may also include a bend 1226 between rearward finger 1202 and annular support 1208. Bends 1216 and 1226 may also act as a spring. In this embodiment, as shown in FIG. 12B, rearward finger 1202, forward finger 1206, and annular support 1208 are in a rest state relative to each other. FIG. 12C shows biasing element 1215 in a rest state 1244 and a biased state 1242. In biased state 1242, a tension force may act to return biasing element 1215 to its rest state 1244. The distance between the ends of inner portion 1220 and inner portion 1210 increases by a distance d3 as biasing element 1215 moves from rest state 1244 to biased state 1242, wherein d3 is the sum of the distances d31 and d32 shown in FIG. 12C. In the embodiment of FIG. 12C, in biased state 1242, forward finger 12016 and rearward finger 1202 do not extend outward beyond annular support 1208. That is, in this embodiment, the outer diameter biasing element 1215 does not increase from unbiased stage 1244 to biased state 1242.

Figure 13A:
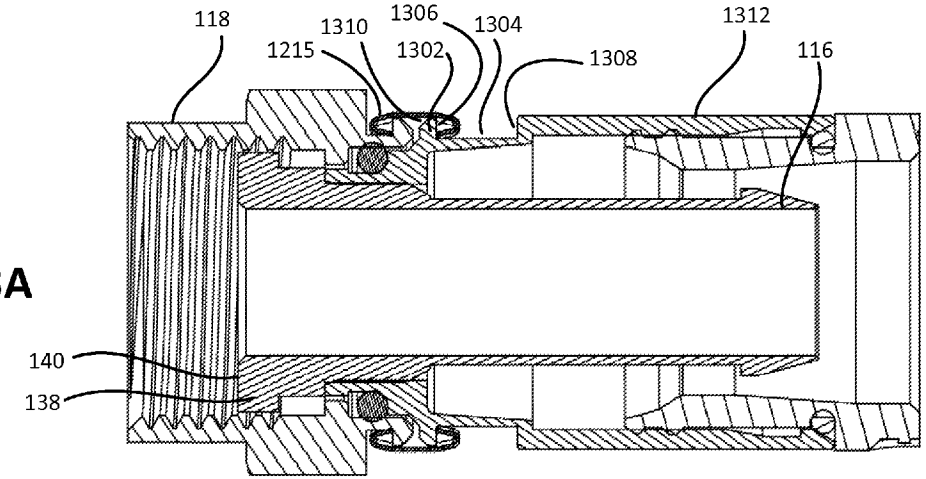
FIG. 13A is a cross-sectional drawing of a connector, including the biasing element of FIG. 12A, wherein the biasing element is in a rest state.

FIG. 13A is a cross-sectional drawing of nut 118, a body 1312, and post 116 in another embodiment. Nut 118, as shown in FIG. 3, includes annular recess 306 having a front wall 308 and a rear wall 310. Nut 118 includes an annular member 302 having an outwardly protruding flange 304 with a beveled edge 312. Connector body 1312, like body 112, may include an elongated, cylindrical member, which can be made from plastic, metal, or any suitable material or combination of materials. Opposite a cable-receiving end, connector body 1312 may include an annular member (or flange) 1302. Annular member 1302 may form an annular recess 1304 between annular member 1302 and the rest of connector body 1312. As shown, recess 1304 includes a forward wall 1306 and a rear wall 1308. In one embodiment, recess 1304 includes forward wall 1306, but no rear wall. That is, recess 1304 is defined by annular member 1302. Annular member 1302 may also include a forward-facing bevel 1310 leading up to recess 1304.

The angle of bevel 312 of nut 118 and the angle of inner portion 1220 of biasing element 1215 may complement each other such that when biasing element 1215 and nut 118 are moved toward each other, forward finger 1206 may snap over annular flange 304 and come to rest in recess 306 of nut 118 (as shown in FIG. 13A). Likewise, the angle of bevel 1310 of body 1312 and the angle of inner portion 1210 of biasing element 1215 may complement each other such that when biasing element 1215 and body 1312 move toward each other, rearward finger 1202 may snap over annular portion 1302 and come to rest in annular recess 1304 of body 1312 (as shown in FIG. 13A). The spring nature of biasing element 1215, as described above, may facilitate the movement of forward finger 1206 over annular flange 304 of nut 118 and the movement of rearward finger 1202 over annular portion 1302 of body 1312.

Figure 13B:
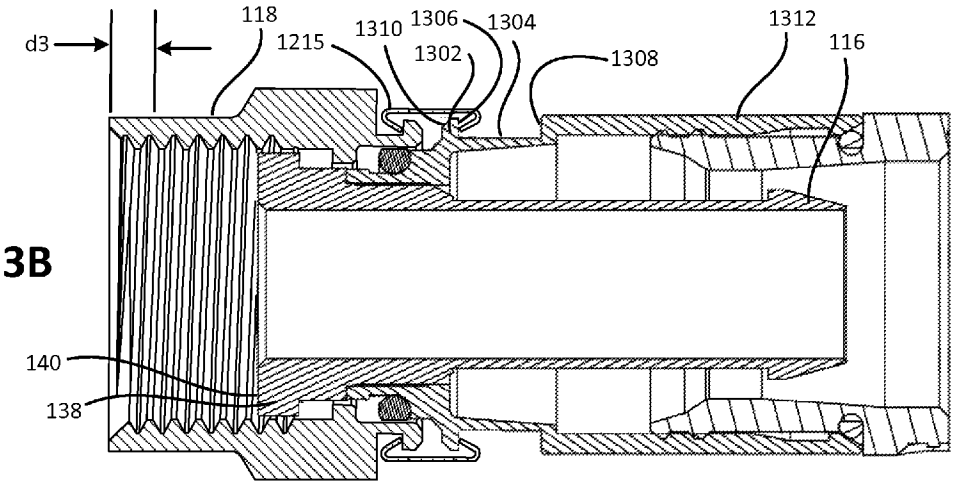
FIG. 13B is a cross-sectional drawing of a connector, including the biasing element of FIG. 12A, wherein the biasing element is in a biased state.

Similar to discussions above with respect to biasing element 115 and 915, the connector shown in FIGS. 13A and 13B may be attached to port 48 (see FIGS. 11A and 11B). In this case, nut 118 may be rotated such that inner threads 154 of nut 118 engage outer threads 52 of port connector 48 to bring surface 53 of port connector 48 into contact with or near front surface 140 of flange 138 of post 116. As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 118 may move nut 118 forward with respect to body 1312 and post 116. In this case, nut 118 may move a distance d3, for example, in the forward direction relative to body 1012. In this case, rear wall 310 of nut 118 may contact inner portion 1220 of forward finger 1206 of biasing element 1215. Likewise, inner portion 1210 of rear finger 1202 may contact front wall 1306 of body 1312. The displacement of nut 118 may flex biasing element 1215 from its rest position 1244 (shown in FIG. 12C) to biased position 1242 (shown in FIG. 12B). Biasing element 1215 provides a tension force on nut 118 in the rearward direction and a tension force on body 1312 in the forward direction.

As biasing element 1215 moves to a biased state, it captures kinetic energy of the rotation of nut 118 and stores the energy as potential energy. Biasing element 1215 provides a load force on nut 118 in the rearward direction and a load force on body 112 in the forward direction. These forces are transferred to threads 52 and 154 (e.g., by virtue of rear surface 53 of port 48 being in contact with post 116, which in this embodiment is fixed relative to body 1312). Tension between threads 52 and 154 may decrease the likelihood that nut 118 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 118 becomes partially loosened (e.g., by a half or full rotation), biasing element 1215 may maintain pressure between surface 53 of port 48 and front surface 140 of post 116, which may help maintain electrical continuity and shielding.

Figure 15A:
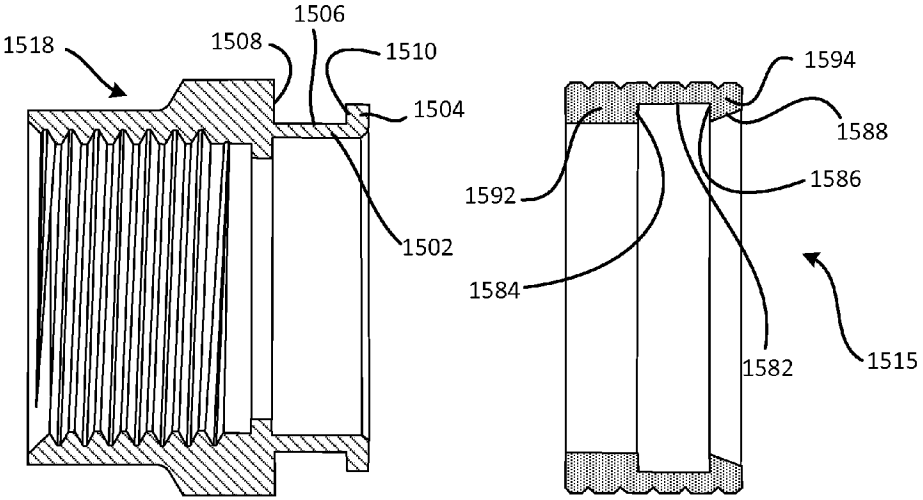
FIG. 15A is a cross-sectional drawing of an exemplary nut and biasing element in another embodiment.
Figure 17:
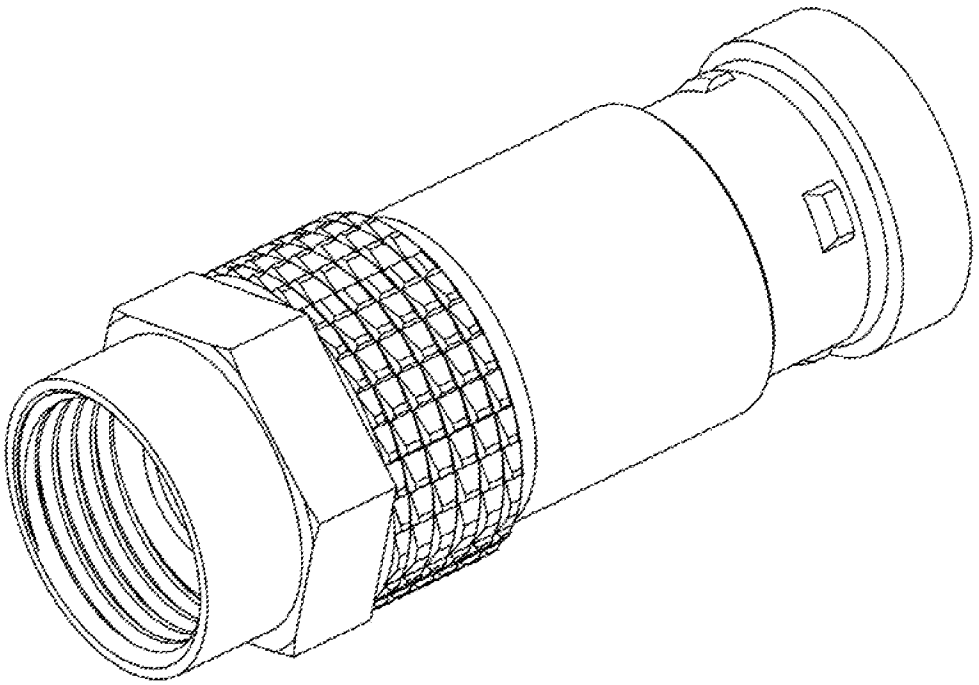
FIG. 17 is a perspective drawing of the biasing element, nut, and connector body of FIG. 15A in an assembled configuration.

In one embodiment, the biasing element may be constructed of a resilient, flexible material such as rubber or a polymer. FIG. 15A is a cross-sectional drawing of a biasing element 1515 and a nut 1518 in one embodiment. FIG. 17 is a perspective drawing of a connector incorporating biasing element 1515 in an assembled state, but not attached to a cable. As shown, biasing element 1515 includes a tubular member having inner and outer surfaces. The inner surface may include an inner recess 1582 having a front wall 1584 and a rear wall 1586. Inner recess 1582 divides biasing element 1515 into a forward end 1592 and a rearward end 1594. The inner surface may also include a rearward facing bevel 1588. The outer surface may include a pattern (e.g., an uneven surface or a knurl pattern) to improve adhesion of biasing element 1515 with an operator's hands. Biasing element 1515 may act as a spring. In this embodiment, FIG. 15A shows biasing element 1515 in its rest state. Any deformation of biasing element 1515 may result in a tension or load force in the direction to return biasing element 1515 to its rest state. Biasing element 1515 may be made from elastomeric material, plastic, metal, or any suitable material or combination of materials. In one embodiment, biasing element 1515, nut 1518, and the connector body are made of a conductive material to enhance conductivity between port connector 48 and post 116.

Nut 1518 may provide for mechanical attachment of a connector to an external device, e.g., port connector 48, via a threaded relationship. Nut 1518 may include any type of attaching mechanisms, including a hex nut, a knurled nut, a wing nut, or any other known attaching means. Nut 1518 may be made from plastic, metal, or any suitable material or combination of materials. As shown, nut 1518 includes a rear annular member 1502 having an outward flange 1504. Annular member 1502 and outward flange 1504 form an annular recess 1506. Annular recess 1506 includes a forward wall 1508 and a rear wall 1510. Unlike nut 118, nut 1518 may not include a rear-facing beveled edge (e.g., beveled edge 312).

Figure 15B:
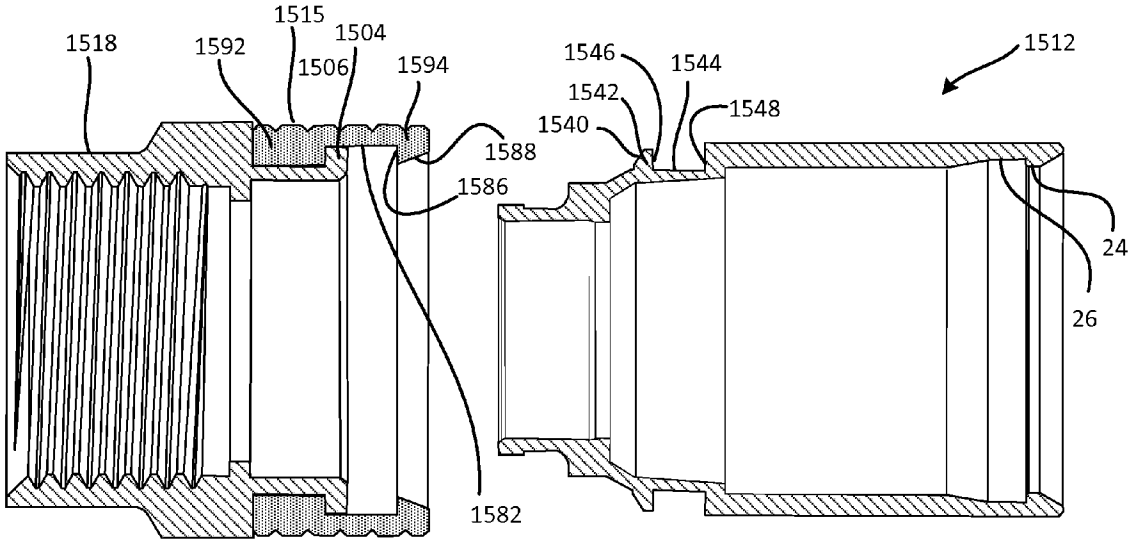
FIG. 15B is a cross-sectional drawing of the nut and biasing element of FIG. 15A and a connector body, wherein the nut and biasing element are coupled together but not coupled to the connector body.

Biasing element 1515 may be over-molded onto nut 1518. FIG. 15B is a cross-sectional drawing of a connector body 1512, nut 1518, and biasing element 1515. As shown in FIG. 15B relative to FIG. 15A, recess 1506 of nut 1518 may be used to form forward end 1592 of biasing element 1515. Further, annular flange 1504 of nut 1518 may be used to form a portion of annular recess 1582 of biasing element 1515, including front wall 1584 of recess 1582. The rest of the inner surface of biasing element 1515 (e.g., the remaining portion of recess 1582, rear wall 1586, and bevel 1588, etc.) may be formed using a collapsible mold structure (not shown), for example. In one embodiment, after over-molding biasing element 1515 onto nut 1518, and collapsing the mold structure that forms the remainder of the inner surface of biasing element 1515 not formed by nut 1518, the resulting arrangement of nut 1518 and biasing element 1515 may be as shown in FIG. 15B.

As shown in FIG. 15B, connector body 1512 may include an elongated, cylindrical member, which can be made from plastic, metal, or any suitable material or combination of materials. Connector body 1512 may include a cable receiving end that includes an inner sleeve-engagement surface 24 and a groove or recess 26. Opposite the cable-receiving end, connector body 1512 may include an annular member (or flange) 1542. Annular member 1542 may form an annular recess 1544 with the rest of connector body 1512. As shown, recess 1544 includes a forward wall 1546 and a rear wall 1548. In one embodiment, recess 1544 includes forward wall 1546, but no rear wall. That is, recess 1544 is defined by annular member 1542. Annular member 1542 may also include a forward-facing bevel 1540 leading up to recess 1544.

Figure 16A:
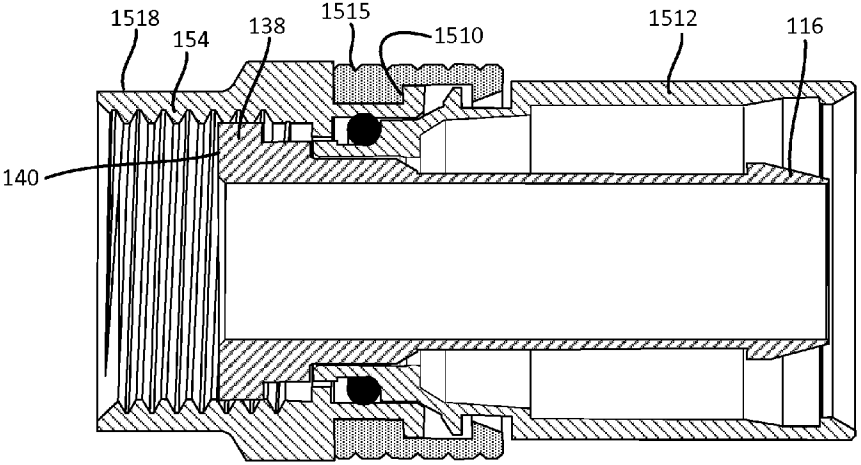
FIG. 16A is a cross-sectional drawing of the biasing element, nut, and connector body of FIG. 15B in an assembled configuration, wherein the biasing element is in a rest state.

As shown in FIG. 15B, the angle of bevel 1540 of body 1512 and the angle of bevel 1588 of biasing element 1515, may complement each other such that when biasing element 1515 and body 1512 move toward each other, rearward portion 1594 may snap over annular portion 1542 and come to rest in annular recess 1544 of body 1512 (as shown in FIG. 16A discussed below). The spring nature of biasing element 1515, as described above, may facilitate the movement of rearward portion 1594 over annular portion 1542 of body 1512.

Figure 16B:
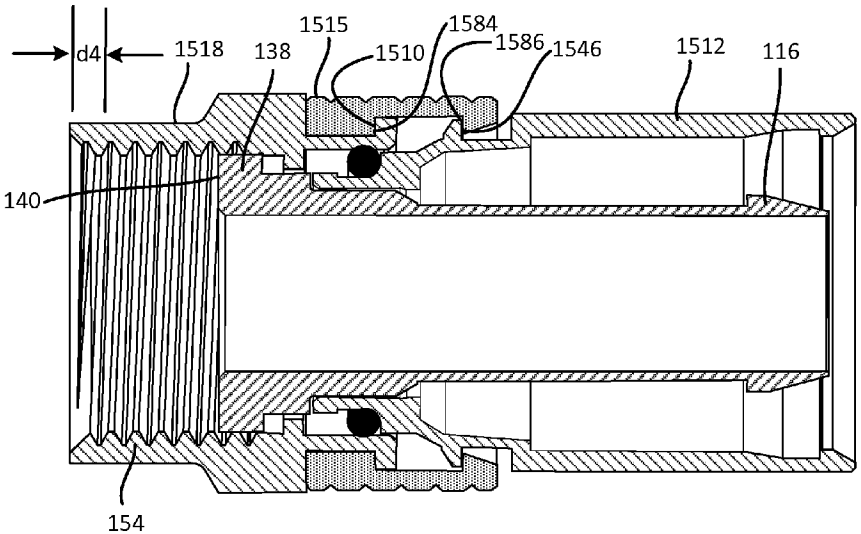
FIG. 16B is a cross-sectional drawing of the biasing element, nut, and connector body of FIG. 15B in an assembled configuration, wherein the biasing element is in a biased state.

FIGS. 16A and 16B are cross-sectional drawings of a connector that incorporates biasing element 1515, nut 1518, post 116, and body 1512. FIG. 16A shows biasing element 1515 in an unbiased state, while FIG. 16B shows biasing element 1515 in a biased state (e.g., an elongated state). Similar to the description above, nut 1518 may be rotated such that inner threads 154 of nut 1518 engage outer threads 52 of port connector 48 to bring surface 53 of port connector 48 into contact with or near front surface 140 of flange 138 of post 116. In the position shown in FIG. 16A, biasing element 1515 is in a rest state and not providing any tension force, for example.

As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 1518 may move nut 118 forward with respect to body 1512 and post 116. As shown in FIG. 16B relative to FIG. 16A, nut 1518 may move a distance d4 in the forward direction relative to body 1512. In this case, rear wall 1510 of nut 1518 may contact forward wall 1584 of biasing element 1515. Likewise, forward wall 1546 of body 1512 may contact rear wall 1586 of biasing element 1515. The displacement of nut 1518 may stretch biasing element 1515 from its rest position (shown in FIG. 16A) to a biased position (shown in FIG. 16B). Biasing element 1515 provides a tension force on nut 1518 in the rearward direction and a tension force on body 1512 in the forward direction.

As biasing element 1515 moves to a biased state, it captures kinetic energy of the rotation of nut 1518 and stores the energy as potential energy. Biasing element 1515 provides a load force on nut 1518 in the rearward direction and a load force on body 1512 in the forward direction. These forces are transferred to threads 52 and 154 (e.g., by virtue of rear surface 53 of port 48 being in contact with post 116, which in this embodiment is fixed relative to body 1512). Tension between threads 52 and 154 may decrease the likelihood that nut 1518 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 1518 becomes partially loosened (e.g., by a half or full rotation), biasing element 1515 may maintain pressure between surface 53 of port 48 and front surface 140 of post 116, which may help maintain electrical continuity and shielding.

Figure 18A:
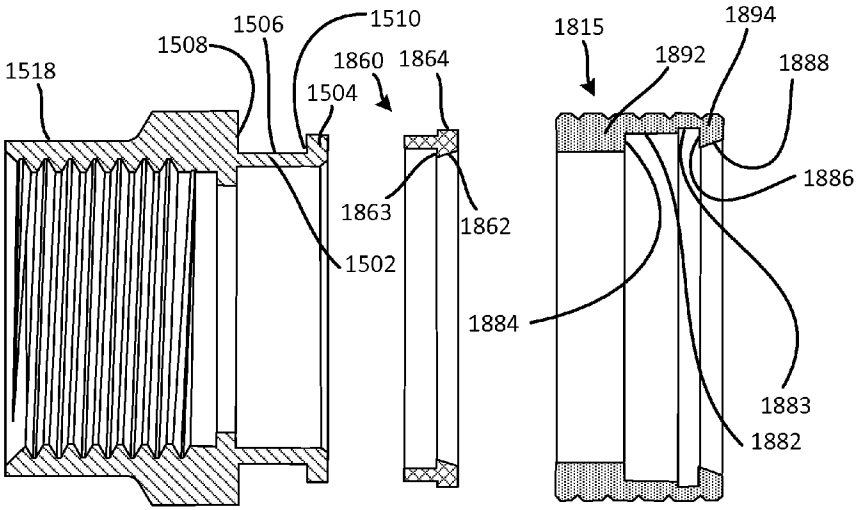
FIG. 18A is a cross-sectional drawing of an exemplary biasing element, nut, and annular ring in another embodiment.

FIG. 18A is a cross-sectional drawing of a biasing element 1815 and nut 1518 in another embodiment. A connector incorporating biasing element 1815 may appear substantially similar to the connector shown in FIG. 17. As shown, biasing element 1815 includes a tubular member having inner and outer surfaces. The inner surface may include an inner recess 1882 having a front wall 1884 and a rear wall 1886. Inner recess 1882 may include an additional recess 1883. The inner surface may also include a rearward facing bevel 1888. The outer surface may include a pattern (e.g., an uneven surface or a knurl pattern) to improve adhesion of biasing element 1815 with an operator's hands. Biasing element 1815 may act as a spring. In this embodiment, FIG. 18A shows biasing element 1815 in its rest state. Any deformation of biasing element 1815 may result in a tension or load force in a direction to return biasing element 1815 to its rest state. Biasing element 1815 may be made from elastomeric material, plastic, metal, or any suitable material or combination of materials. In one embodiment, biasing element 1815, nut 1518, and the connector body are made of a conductive material to enhance conductivity between port connector 48 and post 116. Nut 1518 may is described above with respect to FIG. 15.

Similar to biasing element 1515, biasing element 1815 may be over-molded onto nut 1518. The embodiment of FIG. 18A includes an annular ring 1860. Annular ring 1860 may allow for over-molding without, for example, a collapsible portion for molding the rear portion of biasing element 1815. Annular ring 1860 includes an inner surface and an outer surface. The inner surface includes an inward facing flange 1862 having a beveled rearward edge and a forward facing surface or lip 1863. The outer surface includes an annular flange 1864. Annular ring 1860 may abut nut 1518 (e.g., flange 1504 of annular member 1502) for the over-molding of biasing element 1815 onto nut 1518. Additional recess 1883 may allow for biasing element 1815 to more securely be fastened to annular ring 1860.

Figure 18B:
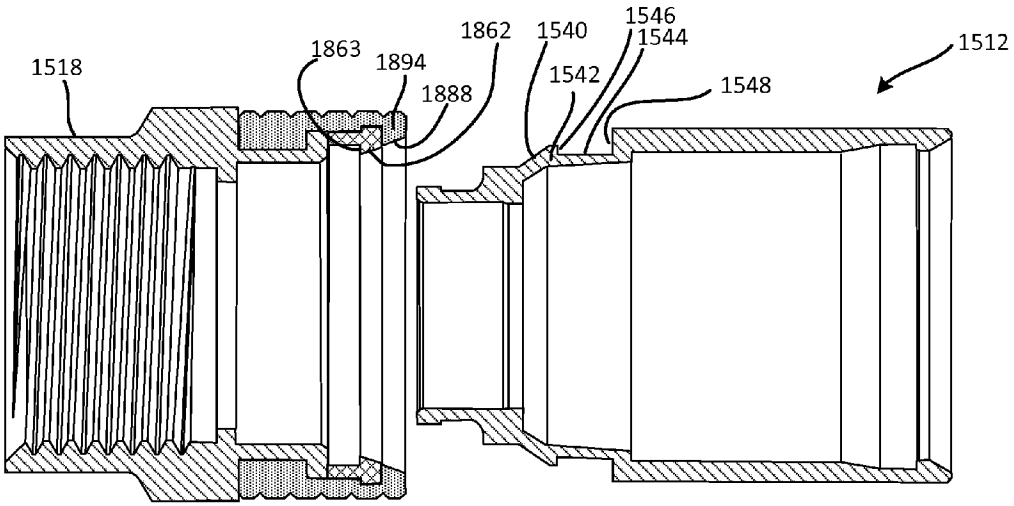
FIG. 18B is a cross-sectional drawing of the nut, biasing element, and annular ring of FIG. 18A, and a connector body, wherein the nut, biasing element, and annular ring are coupled together but not coupled to the connector body.

FIG. 18B is a cross-sectional drawing of connector body 1512, nut 1518, and biasing element 1815. Connector body 1512 shown in FIG. 18B is similar to the connector body described above with respect to FIG. 15B. As shown in FIG. 18B relative to FIG. 18A, recess 1506 of nut 1518 may be used to form forward end 1892 of biasing element 1815. Further, annular flange 1504 of nut 1518 may be used (e.g., in an over-molding process) to form a portion of annular recess 1882 of biasing element 1815, including front wall 1884 of biasing element 1815. The rest of the inner surface of biasing element 1815 (e.g., the remaining portion of recess 1882, rear wall 1886, etc.) may be formed by over-molding biasing element 1815 onto annular ring 1860. In one embodiment, after over-molding biasing element 1815 onto nut 1518 and annular ring 1860, the arrangement of nut 1518, biasing element 1815, and annular ring 1860 may be as shown in FIG. 18B.

Figure 19A:
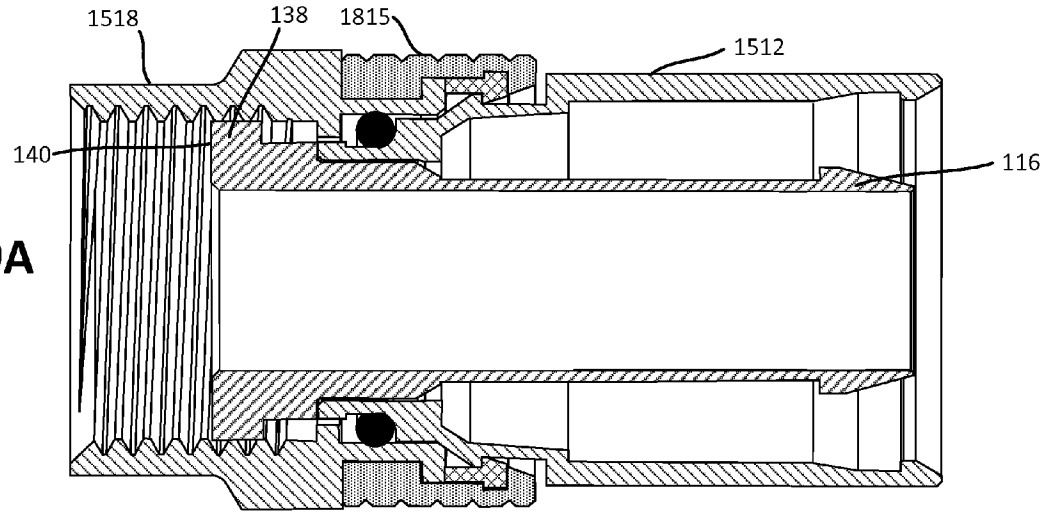
FIG. 19A is a cross-sectional drawing of the biasing element, nut, annular ring, and connector body of FIG. 18B in an assembled configuration, wherein the biasing element is in a rest state.

As shown in FIG. 18B, the angle of bevel 1888 of biasing element 1815 and/or the angle of the bevel of inner flange 1862 of annular ring 1860 may complement the angle of bevel 1540 of body 1512 such that when biasing element 1815 and annular ring 1860 are moved toward body 1512, the inner flange 1862 of annular ring 1860 and rearward portion 1894 of biasing element 1815 may snap over annular portion 1542 and come to rest in annular recess 1544 of body 1512 (as shown in FIG. 19A). The spring nature of biasing element 1815, as described above, may facilitate the movement of rearward portion 1894 over annular portion 1542 of body 1512.

Figure 19B:
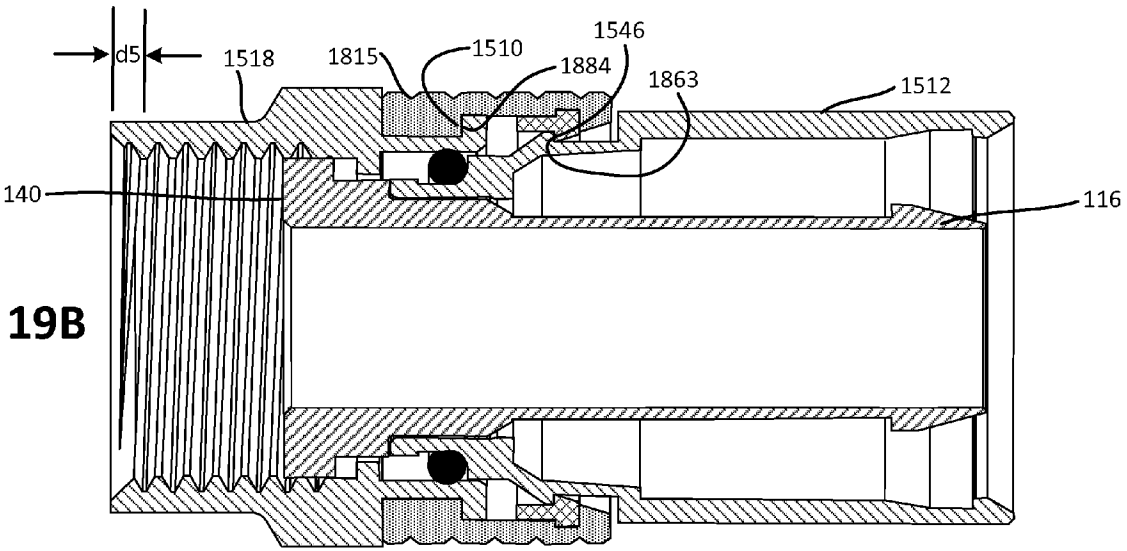
FIG. 19B is a cross-sectional drawing of the biasing element, nut, annular ring, and connector body of FIG. 18B in an assembled configuration, wherein the biasing element is in a biased state.

FIGS. 19A and 19B are cross-sectional drawings of a connector that incorporates biasing element 1815, nut 1518, connector body 1512, and post 116. FIG. 19A shows biasing element 1815 in an unbiased state, while FIG. 19B shows biasing element 1815 in a biased state (e.g., an elongated state). As described above, nut 1518 may be rotated such that inner threads 154 of nut 1518 engage outer threads 52 of port connector 48 to bring surface 53 of port connector 48 into contact with or near front surface 140 of flange 138 of post 116. In the position shown in FIG. 19A, biasing element 1815 is in a rest state and not providing any tension force, for example.

As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 1518 may move nut 1518 forward with respect to body 1512 and post 116. As shown in FIG. 19B relative to FIG. 19A, nut 1518 may move a distance d5 in the forward direction relative to body 1512. In this case, rear wall 1510 of nut 1518 may contact forward wall 1884 of biasing element 1815. Likewise, forward wall 1546 of body 1512 may contact lip 1863 of annular member 1860, which is coupled to biasing element 1815. As a result, the displacement of nut 1518 may stretch biasing element 1815 from its rest position (shown in FIG. 19A) to a biased position (shown in FIG. 19B). Biasing element 1815 provides a tension force on nut 1518 in the rearward direction and a tension force on body 1512 in the forward direction.

As biasing element 1815 moves to a biased state, it captures kinetic energy of the rotation of nut 1518 and stores the energy as potential energy. Biasing element 1815 provides a load force on nut 1518 in the rearward direction and a load force on body 1512 in the forward direction. These forces are transferred to threads 52 and 154 (e.g., by virtue of rear surface 53 of port 48 being in contact with post 116, which in this embodiment is fixed relative to body 1512). Tension between threads 52 and 154 may decrease the likelihood that nut 1518 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 1518 becomes partially loosened (e.g., by a half or full rotation), biasing element 1815 may maintain pressure between surface 53 of port 48 and front surface 140 of post 116, which may help maintain electrical continuity and shielding.

Figure 21:
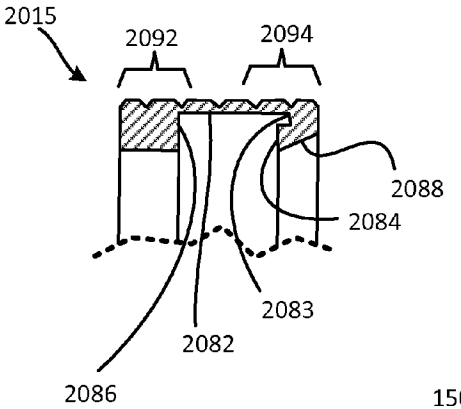
FIG. 21 is a cross-sectional drawing of the exemplary biasing element of the connector shown of FIG. 20.
Figure 20:
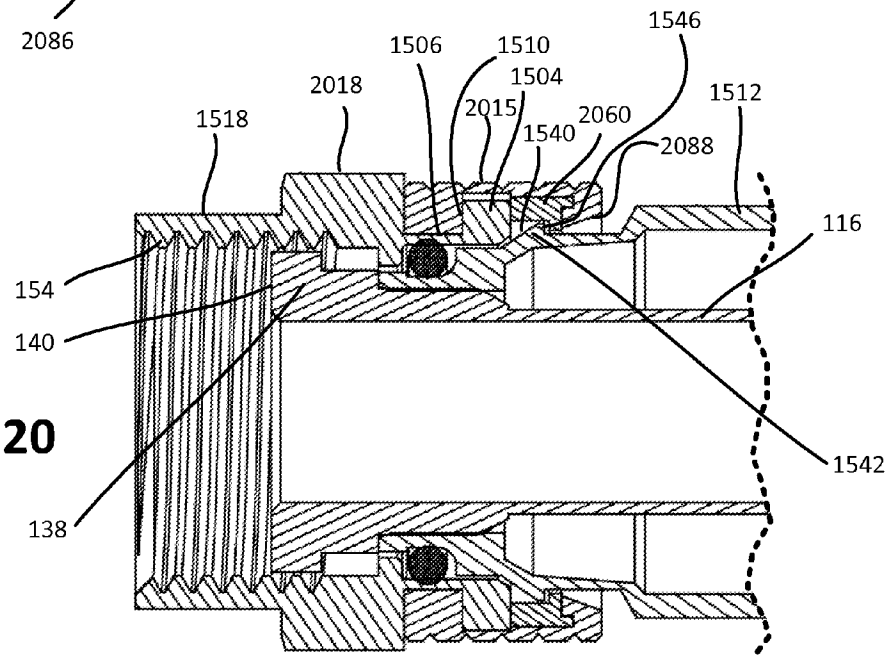
FIG. 20 is a cross-sectional drawing of an exemplary connector including a biasing element in another embodiment.
Figure 24B:
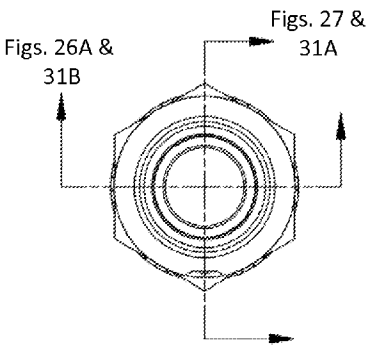
FIG. 24B is a drawing of the front of the connector as shown in FIG. 24A.

FIG. 20 is a cross-sectional drawing of a connector including a biasing element 2015 in another embodiment. FIG. 21 is a cross-sectional drawing of a portion of biasing element 2015. A connector incorporating biasing element 2015 may appear substantially similar to the connector shown in FIG. 17. As shown, biasing element 2015 includes a tubular member having inner and outer surfaces. The inner surface may include an inner recess 2082 having a front wall 2084 and a rear wall 2086. Inner recess 2082 may include an additional recess 2083. The inner surface may also include a rearward facing bevel 2088. The outer surface may include a pattern (e.g., an uneven surface or a knurl pattern) to improve adhesion of biasing element 2015 with an operator's hands. Biasing element 2015 may act as a spring. In this embodiment, FIG. 20 shows biasing element 2015 in its rest state. Any deformation of biasing element 2015 may result in a tension or load force in a direction to return biasing element 2015 to its rest state. Biasing element 2015 may be made from elastomeric material, plastic, metal, or any suitable material or combination of materials. In one embodiment, biasing element 2015, nut 1518, and connector body 1512 are made of a conductive material to enhance conductivity between port connector 48 and post 116. Nut 1518, shown in FIG. 20, is similar to nut 1518 described above with respect to FIG. 15.

Figure 22:
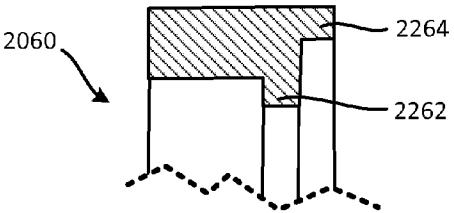
FIG. 22 is a cross-sectional drawing of the exemplary annular ring of the connector shown in FIG. 20.

FIG. 22 is a cross-sectional diagram of annular ring 2060. Similar to biasing element 1815, biasing element 2015 may be over-molded onto nut 1518 and annular ring 2060. Like annular ring 1860, annular ring 2060 may allow for over-molding without, for example, a collapsible portion for molding the rear portion of biasing element 2015. Annular ring 2060 includes an inner surface and an outer surface. The inner surface includes an inner flange 2262 and a rearward flange 2264. Annular ring 2060 may abut nut 1518 for the over-molding of biasing element 2015 onto nut 1518. Rearward flange 2264 may form recess 2083 in biasing element 2015. Additional recess 2083 may allow for biasing element 2015 to more securely be fastened to annular ring 2060. Inward flange 2262 may allow for a better grip by annular member 2060 to body 2018.

Connector body 1512 shown in FIG. 20 is substantially similar to the connector body described above with respect to FIG. 15B. As shown in FIG. 20, recess 1506 of nut 1518 may be used to form forward end 2092 of biasing element 2015. Further, annular flange 1504 of nut 1518 may be used to form a portion of annular recess 2082 of biasing element 2015, including front wall 2086 of recess 2082. The rest of the inner surface of biasing element 2015 (e.g., the remaining portion of recess 2082, rear wall 2084, additional recess 2083, etc.) may be formed by over-molding biasing element 2015 onto annular ring 2060. In one embodiment, after over-molding biasing element 2015 onto nut 1518 and annular ring 2060, the arrangement of nut 1518, biasing element 1515, and annular ring 2060 may be as shown in FIG. 20.

As shown in FIG. 20, the angle of bevel 2088 of biasing element 2015 may complement the angle of bevel 1540 of body 1512 such that when biasing element 2015 and annular ring 2060 are moved toward body 1512, the rear end of annular ring 2060 and rearward portion 2094 of biasing element 2015 may snap over annular portion 1542 and come to rest in annular recess 1544 of body 1512 (as shown in FIG. 20). The spring nature of biasing element 2015, as described above, may facilitate the movement of rearward portion 2094 over annular portion 1542 of body 1512.

As with the connector shown in FIGS. 19A and 19B, nut 1518 in FIG. 20 may be rotated such that inner threads 154 of nut 1518 engage outer threads 52 of port connector 48 to bring surface 53 of port connector 48 into contact with or near front surface 140 of flange 138 of post 116. In the position shown in FIG. 20, biasing element 2015 is in a rest state and not providing any tension force, for example. As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 1518 may move nut 1518 forward with respect to body 1512 and post 116. Nut 1518 may move a distance (not shown) in the forward direction relative to body 1512. In this case, rear wall 1510 of nut 1518 may contact forward wall 2084 of biasing element 2015. Likewise, forward wall 1546 of body 1512 may contact annular ring 2060. The displacement of nut 1518 may stretch biasing element 2015 from its rest position (shown in FIG. 20) to a biased position (not shown), similar to the description above with respect to FIG. 19B. Biasing element 2015 provides a tension force on nut 1518 in the rearward direction and a tension force on body 1512 in the forward direction.

As biasing element 2015 moves to a biased state, it captures kinetic energy of the rotation of nut 1518 and stores the energy as potential energy. Biasing element 2015 provides a load force on nut 1518 in the rearward direction and a load force on body 1512 in the forward direction. These forces are transferred to threads 52 and 154 (e.g., by virtue of rear surface 53 of port 48 being in contact with post 116, which in this embodiment is fixed relative to body 1512). Tension between threads 52 and 154 may decrease the likelihood that nut 1518 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 1518 becomes partially loosened (e.g., by a half or full rotation), biasing element 2015 may maintain pressure between surface 53 of port 48 and front surface 140 of post 116, which may help maintain electrical continuity and shielding.

Figure 23B:
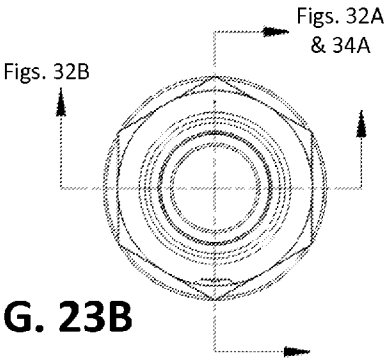
FIG. 23B is a drawing of the front of the connector of FIG. 23A.
Figure 23A:
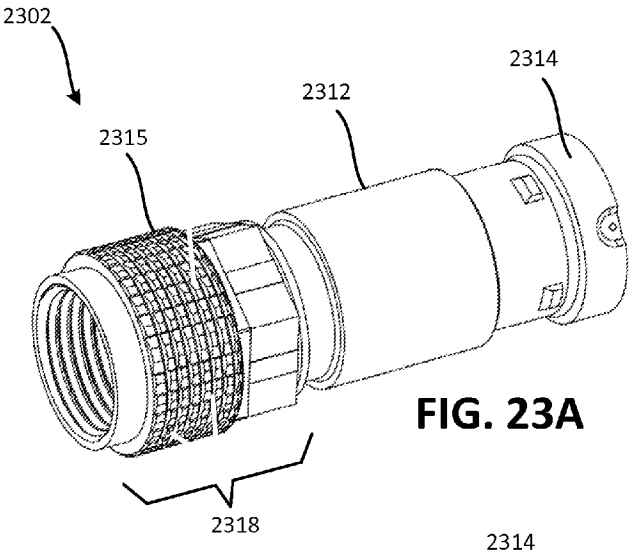
FIG. 23A is a perspective drawing of a connector including a biasing element in another embodiment.
Figure 24A:
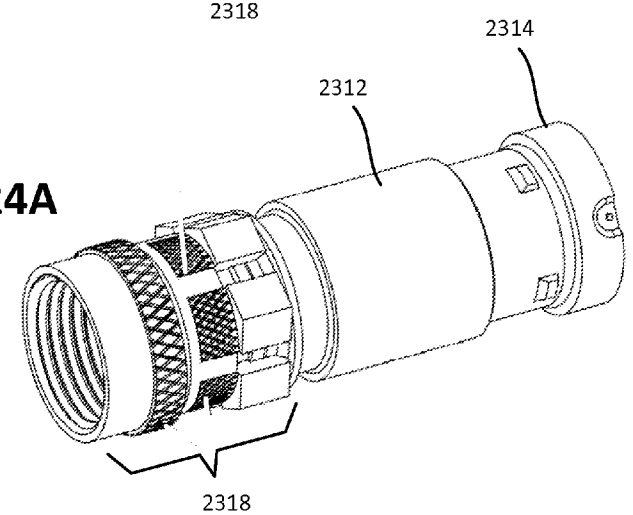
FIG. 24A is a perspective drawing of the connector of FIGS. 23A and 23B without the biasing element.

FIG. 23A is a perspective drawing of an exemplary connector 2302 in another embodiment. Connector 2302 includes a nut 2318, a biasing element 2315, a connector body 2312, and a locking sleeve 2314. Biasing element 2315, like biasing element 1515, biasing element 915, and biasing element 2015 may include an elastomeric material. For ease of understanding, FIG. 24A is a perspective drawing of connector 2302 without the biasing element 2315.

Figure 25A:
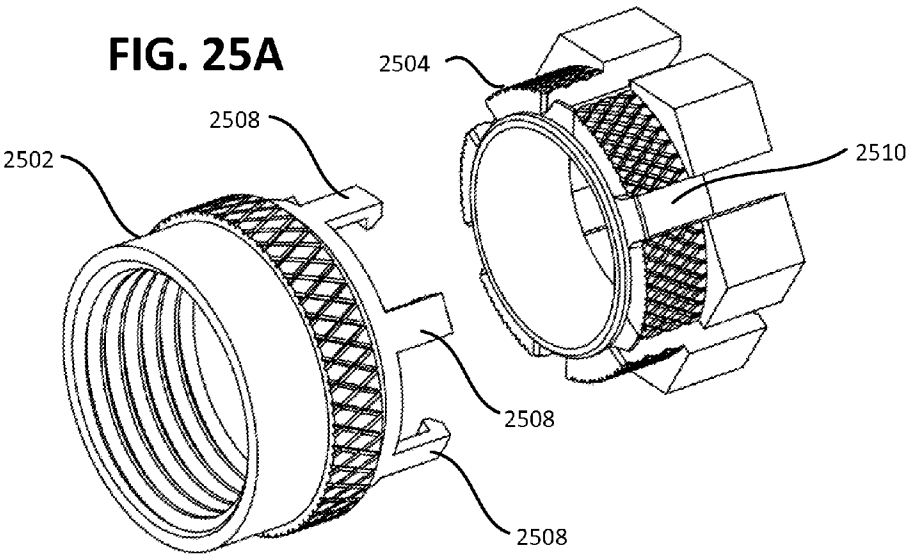
FIG. 25A is a perspective drawing of a front portion and a back portion of the nut of the connector of FIG. 23A, wherein the front portion and the back portion are not coupled together.
Figure 25B:
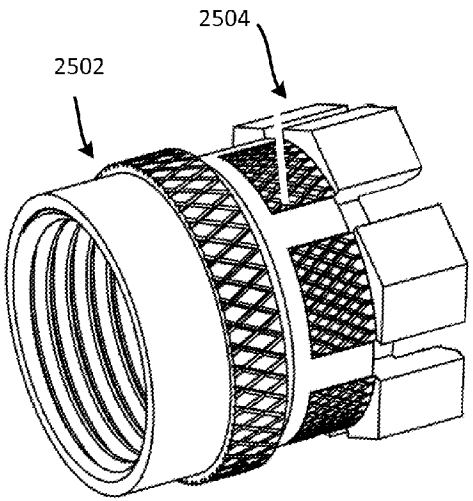
FIG. 25B is a perspective drawing of the back portion and the front portion of the nut of the connector of FIG. 23A, wherein the front portion and the back portion are coupled together.

Nut 2318 of connector 2302 may be formed in two parts, namely a front and a back part. FIG. 25A is a perspective drawing of a front portion 2502 and a rear portion 2504 of nut 2318. Front portion 2502 includes a cylindrical body having inner threads and rearward facing fingers 2508 (individually, "rearward facing finger 2508"). Rear portion 2504 includes a cylindrical body with a plurality of slots 2510 that, in this embodiment, are formed on the outer surface of rear portion 2504. FIG. 25B is a perspective drawing of front portion 2502 and rear portion 2504 coupled together. In the embodiment of FIG. 25B, rearward fingers 2508 fit into slots 2510.

Figure 26A:
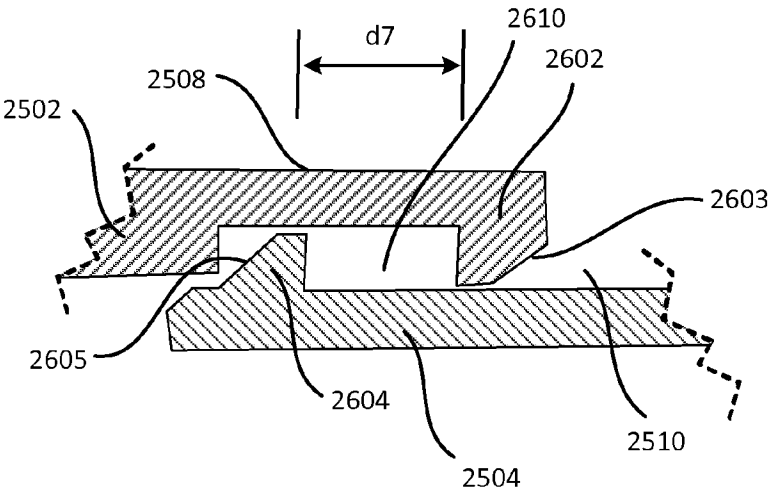
FIGS. 26A and 26B are cross-sectional drawings of the coupling between the front and back portion of the nut as shown in FIG. 25B.
Figure 26B:
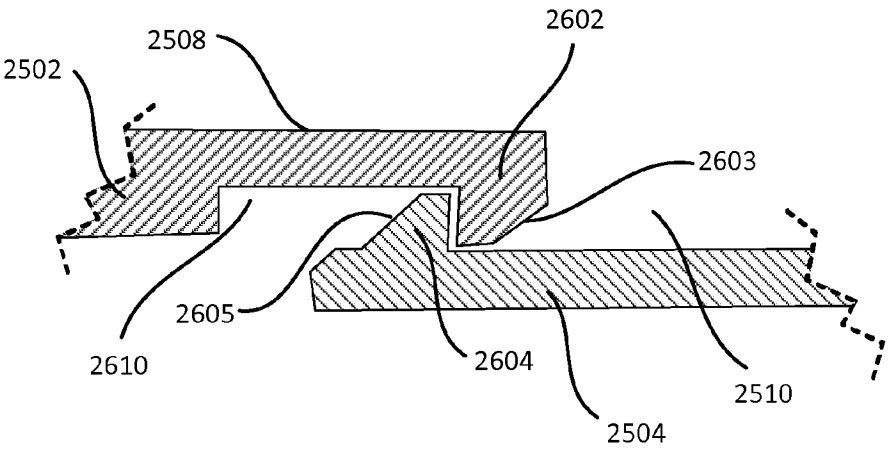

FIG. 26A includes a cross-sectional drawing of rearward facing fingers 2508 of front portion 2502 and rear portion 2504 when front portion 2502 and rear portion 2504 are coupled together, as shown in FIG. 25B. As shown in FIG. 26A, rearward facing finger 2508 includes an inward facing flange 2602 that defines a recess 2610. Inward flange 2602 may include a beveled edge 2603. Rear portion 2504 includes an outward flange 2604 that protrudes from slot 2510 into recess 2610. Outward flange 2604 includes a beveled edge 2605. Beveled edge 2603 of inward flange 2602 (e.g., finger 2508) and beveled edge 2605 of outward flange 2604 (e.g., slot 2510 of rear portion 2504) may complement each other so that when finger 2508 is moved into slot 2510 onto rear portion 2504 (e.g., from the configuration shown in FIG. 25A to the configuration shown in FIG. 25B), finger 2508 will snap over outward flange 2604 into slot 2510 and outward flange 2604 will reside in recess 2610. Once inward flange 2602 of finger 2508 is in slot 2510 and outward flange 2604 is in recess 2610, inward flange 2602 and outward flange 2604 may act to prevent finger 2508 from being removed from slot 2510. Nonetheless, as shown in FIG. 26A, front portion 2502 and rear portion 2504 may be free to move a distance d7 relative to each other. FIG. 26B is a cross-sectional drawing showing front portion 2502 having been moved a distance d7 relative to rear portion 2504 as compared to the components as shown in FIG. 26A.

Figure 27:
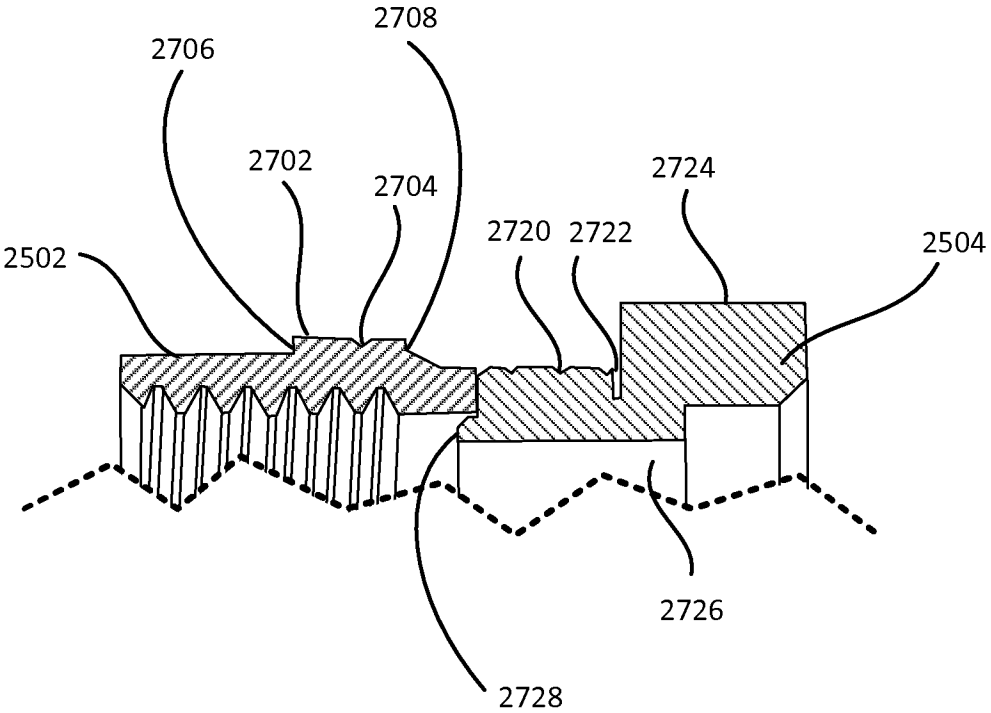
FIG. 27 is a cross-sectional diagram of the coupling between the front and back portion of the nut as shown in FIG. 25B.

FIG. 27 is a cross-sectional drawing of front portion 2502 and rear portion 2504 of nut 2315. Front portion 2502 includes an outer ridge 2702. Outer ridge 2702 includes a pattern 2704 (e.g., an uneven surface or a knurl pattern) for improved adhesion of biasing element 2315 to front portion 2502. Outer ridge 2702 includes a forward edge 2706 and a rearward edge 2708. Edges 2706 and 2708 may also act to improve adhesion of biasing element 2315 to front portion 2502. When forward portion 2502 moves away from rear portion 2504, for example, forward edge 2706 and knurl pattern 2704 may act to stretch (e.g., exert a force on) biasing element 2315 from its rest state to its biased state.

As shown in FIG. 27, rear portion 2504 also includes a knurl pattern 2720 on its outer surface. Knurl pattern 2720 may improve adhesion of biasing element 2315 to rear portion 2504. Rear portion 2504 may also include a recess 2722 for added adhesion of biasing element 2315 to rear portion 2504. Well 2722 may receive biasing element 2315 during the over molding process. Further, rear portion 2504 may include an outer surface 2724 for receiving a tool for tightening nut 2318 onto a port of electronic equipment. Rear portion 2504 may also include an inner surface 2726 with a forward flange 2728. Inner surface 2726 of rear portion 2504 may include a diameter from the center of connector 2302 such that back portion is captured between post 116 and connector body 2312 of connector 2302.

Figure 28:
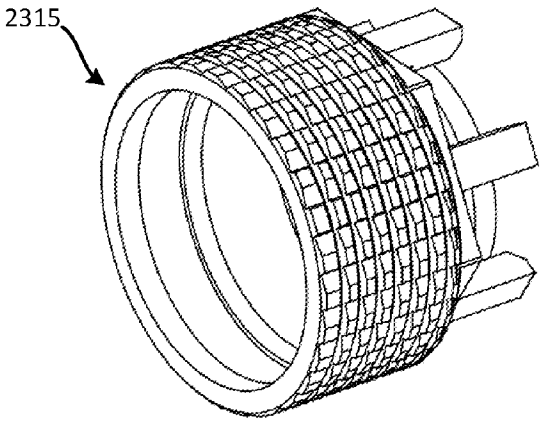
FIG. 28 is a perspective drawing of the biasing element of the connector as shown in FIG. 23A.
Figure 29:
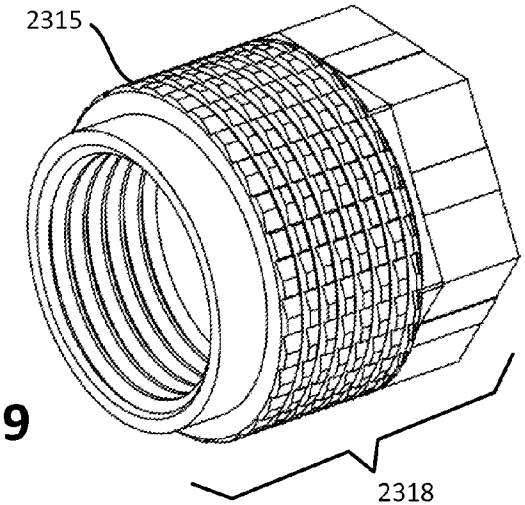
FIGS. 29 and 30 are perspective drawings of the nut of the connector of FIG. 23A including the biasing element.
Figure 30:
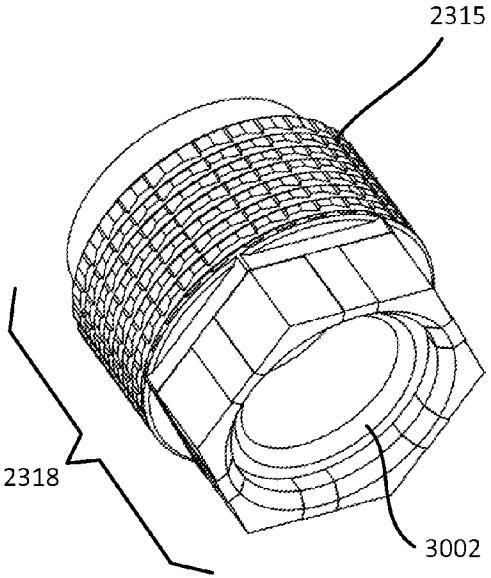

FIG. 28 is a perspective drawing of biasing element 2315. Biasing element 2315 may be molded over front portion 2502 and rear portion 2504. FIG. 29 is a perspective drawing of biasing element 2315 molded over front portion 2502 and rear portion 2504. FIG. 30 is also a perspective drawing of biasing element 2315 molded over front portion 2502 and rear portion 2504, but from the rear perspective. As discussed in more detail below, a portion of biasing element 2315 may also act as a seal 3002.

Figure 31A:
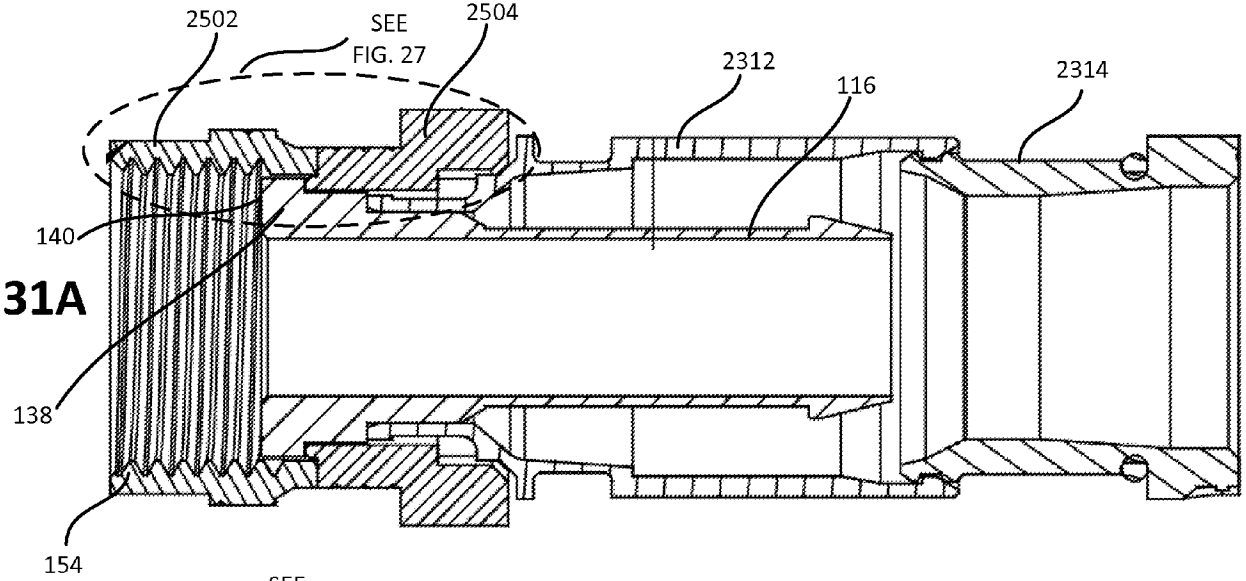
FIGS. 31A and 31B are cross-sectional drawings of the connector of FIG. 23A without the biasing element.
Figure 31B:
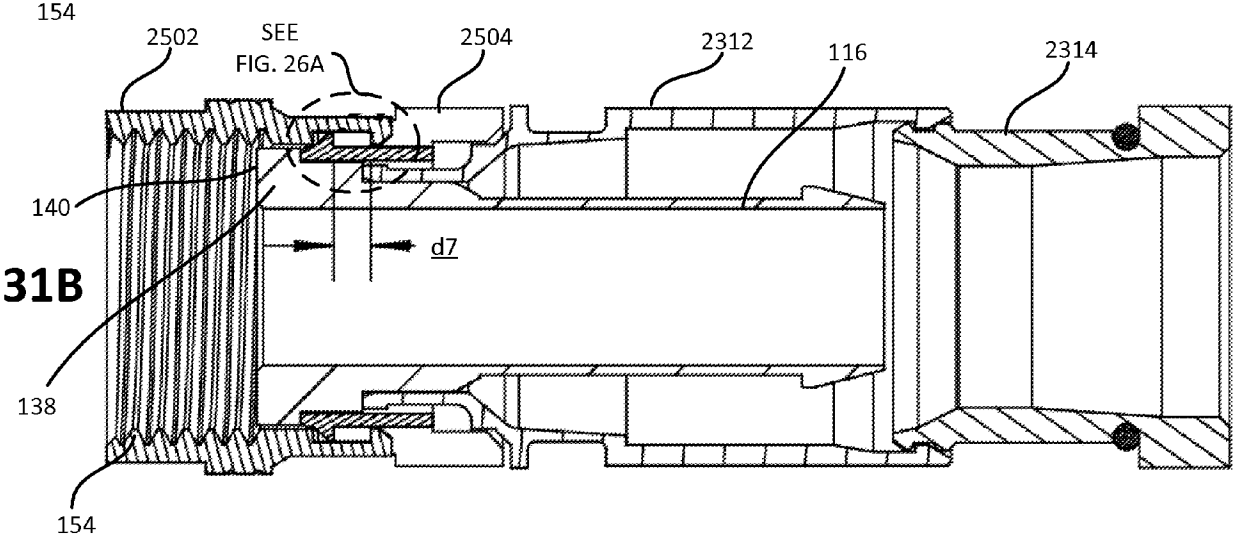

FIG. 31A is a cross-sectional drawing of connector 2302 without biasing element 2315 (see FIG. 24A). As shown in FIG. 31A, post 116 and body 2312 captures rear portion 2504 of nut 2318. FIG. 31B is also a cross-sectional drawing of connector 2302 without biasing element 2315 (with respect to a different plane than FIG. 31A). As shown in FIG. 31B, front portion 2502 of nut 2318 may travel a distance of d7 before rear portion 2504 prevents front portion 2502 from moving further.

Figure 32A:
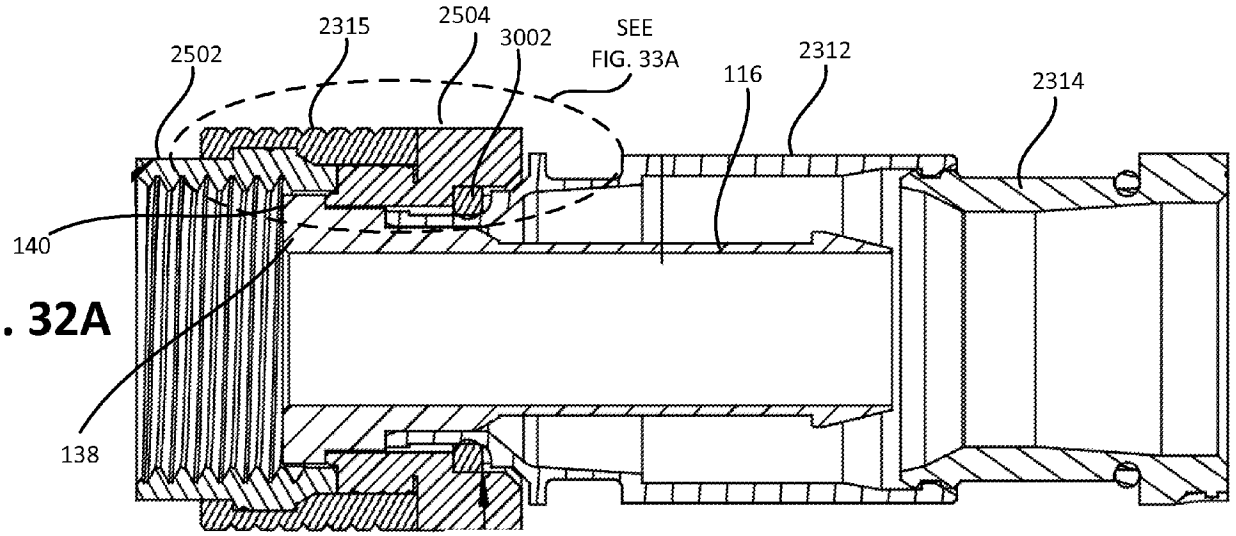
FIGS. 32A and 32B are cross-sectional drawings of the connector of FIG. 23A with the biasing element.
Figure 32B:
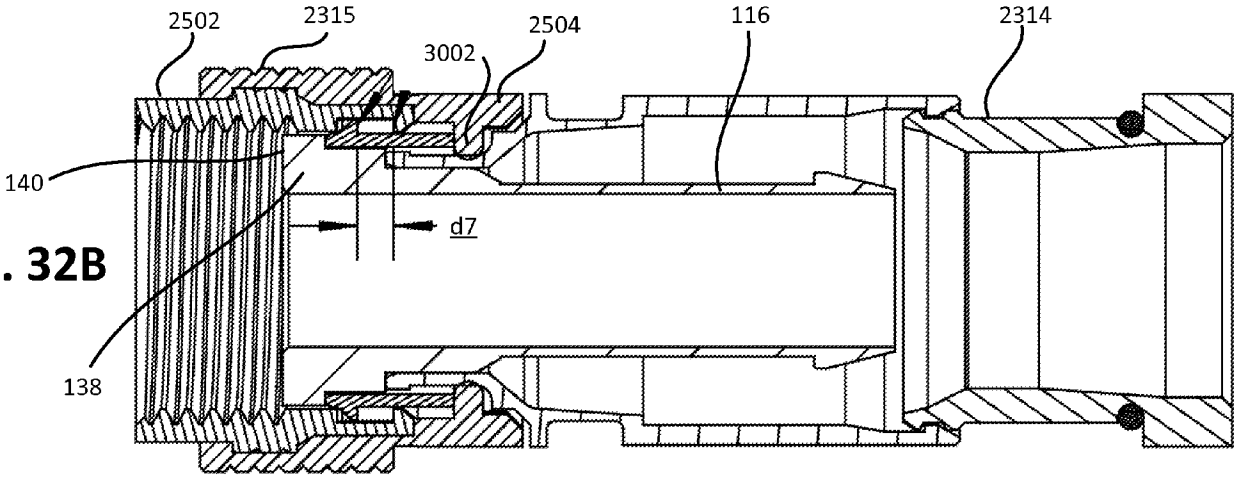

FIG. 32A is a cross-sectional drawing of connector 2302 with biasing element 2315 in a rest state (see FIG. 23A). As shown in FIG. 32A, post 116 and body 2312 captures rear portion 2504 of nut 2318. FIG. 31B is also a cross-sectional drawing of connector 2302 with biasing element 2315 in a rest state (with respect to a different plane than FIG. 32A). As shown in FIG. 32B, a portion of biasing element 2315 may also act as seal 3002. Seal 3002 may keep water and/or other elements from reaching, for example, surface 140 of flange 138 of post 116 so as to help maintain electrical connectivity. As shown in FIG. 32B, front portion 2502 of nut 2318 may travel a distance of d7 before rear portion 2504 prevents front portion 2502 from moving further.

Figure 33:
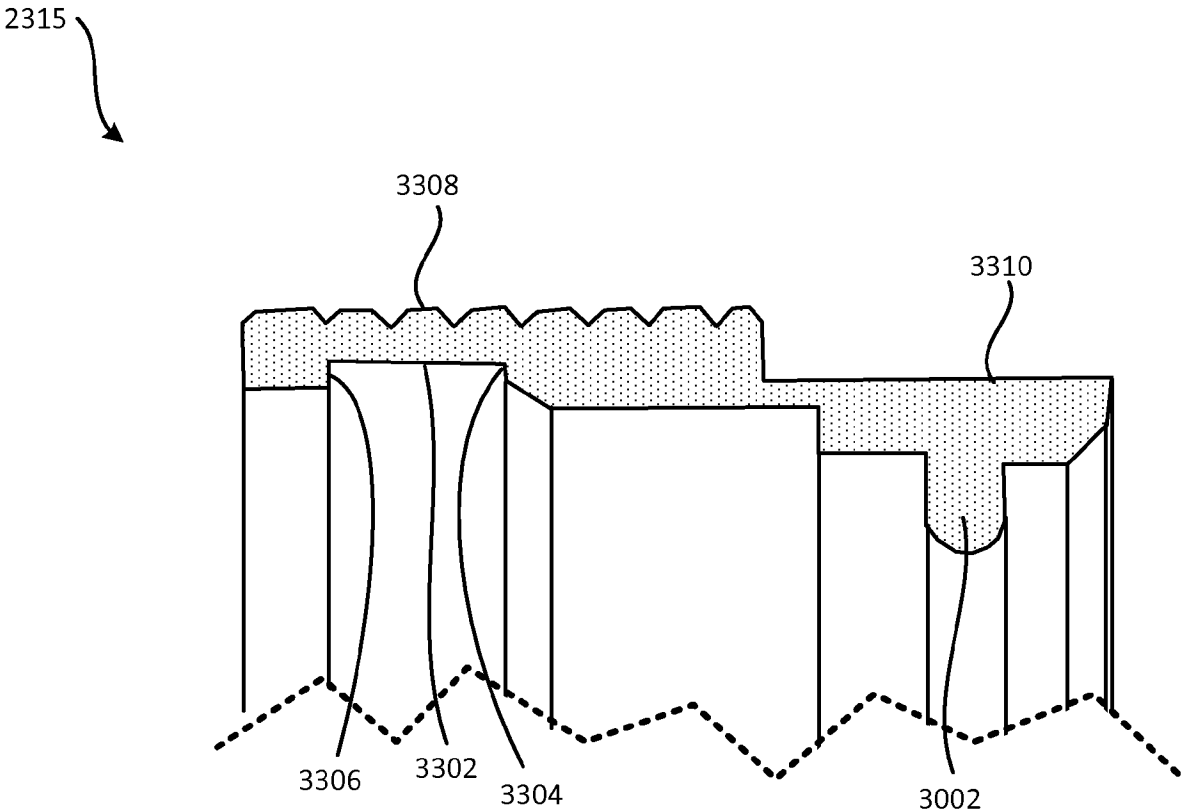
FIG. 33 is a cross-sectional drawing of the biasing element of the connector of FIG. 23A.

FIG. 33 is a cross-sectional drawing of biasing element 2315 as shown in FIG. 32B. Biasing element 2315 includes an inner surface and an outer surface. The outer surface may include a surface 3308 with a pattern (e.g., an uneven surface or a knurl pattern) to improve adhesion of biasing element 2315 with an operator's hands. The outer surface may also include a surface 3310 to allow for a tool to rotate nut 2318. The inner surface includes a recess 3302 having a forward wall 3306 and a rearward wall 3304. Recess 3302, forward wall 3306, and rear wall 3304 may be formed by molding biasing element 2315 over outer ridge 2702 (see FIG. 27). Forward wall 3306 and rearward wall 3304 may also act to improve adhesion of biasing element 2315 to front portion 2502. When front portion 2502 moves away from rear portion 2504, for example, forward edge 3306 may capture edge 2706 of front portion 2502 to stretch (e.g., exert a force on) biasing element 2315 from its rest state to its biased state. Seal 3002 may also be coupled to rear portion 2504, for example, to keep the rear end of biasing element 2315 captured so that when front portion 2502 moves away from rear portion 2504, biasing element is stretched from a rest state to a biased state.

Figure 34A:
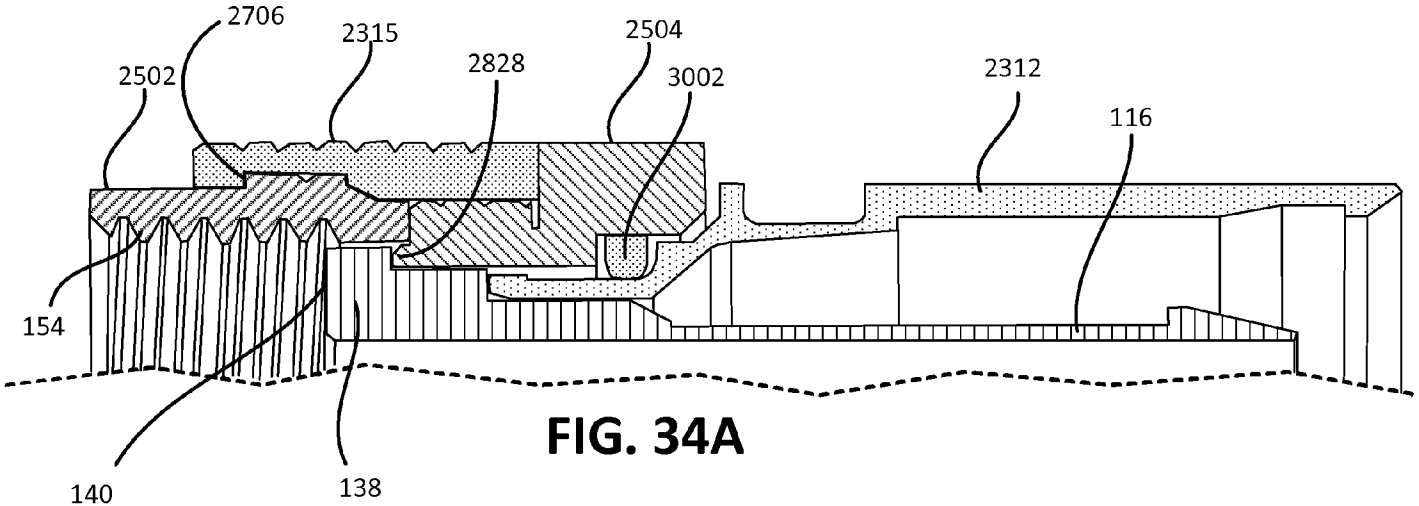
FIGS. 34A and 34B are cross-sectional drawings of the connector of FIGS. 23A and 23B with the biasing element in a rest and a biased state, respectively.
Figure 34B:
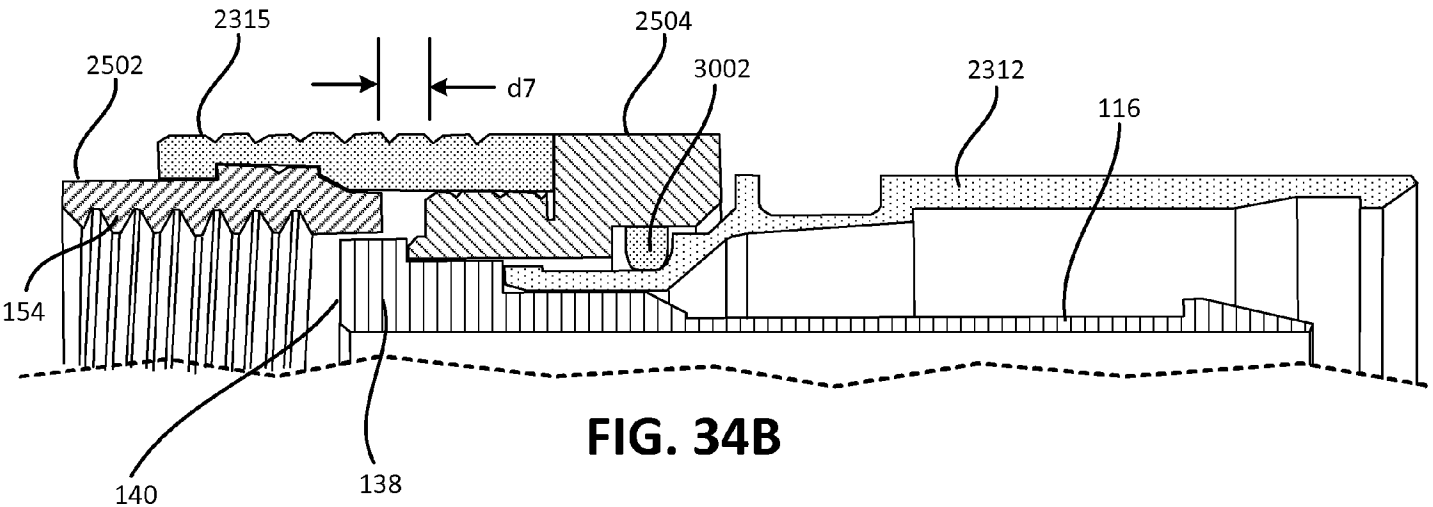

FIG. 34A is a cross-sectional drawing of connector 2302 with biasing element 2315 in a rest position, similar to FIG. 32A. FIG. 34B is a cross-sectional drawing of connector 2302 with biasing element in a biased state after having moved a distance d7. Nut 2318 may be rotated such that the inner threads 154 of nut 2318 engage outer threads 52 of port connector 48 to bring surface 53 of port connector 48 into contact with or near front surface 140 of flange 138 of post 116. In the position shown in FIG. 34A, biasing element 2315 is in a rest state and not providing any tension force, for example. As discussed above, the conductive nature of post 116, when in contact with port connector 48, may provide an electrical path from surface 53 of port connector 48 to braid 64 around coaxial cable 56, providing proper grounding and shielding. After surface 53 of port connector 48 contacts front surface 140 of post 116, continued rotation of nut 2318 may move nut 2318 forward with respect to body 2312 and post 116. Nut 2318 may move a distance d7 in the forward direction relative to body 2312. The displacement of nut 2318 may stretch biasing element 2315 from its rest position (shown in FIG. 34A) to a biased position (shown in FIG. 34B). Biasing element 2015 provides a tension force on front portion 2502 of nut 2318 in the rearward direction and a tension force on body 1512 in the forward direction (by virtue of back portion 2504 butting up against flange 138 of post 116, which is fixed relative to body 2312).

As biasing element 2315 moves to a biased state, it captures kinetic energy of the rotation of nut 2318 and stores the energy as potential energy. Biasing element 2315 provides a load force on front portion 2502 of nut 2318 in the rearward direction and a load force on body 2312 in the forward direction (by virtue of rear portion 2504 butting up against flange 138 of post 116, which is fixed relative to body 2312). These forces are transferred to threads 52 and 154 (e.g., by virtue of rear surface 53 of port 48 being in contact with post 116, which in this embodiment is fixed relative to body 1512). Tension between threads 52 and 154 may decrease the likelihood that nut 2318 becomes loosened from port connector 48 due to external forces, such as vibrations, heating/cooling, etc. Tension between threads 52 and 154 also increases the likelihood of a continuous grounding and shielding connection between cylindrical body 50 (e.g., surface 53) of port 48 and post 116 (e.g., front surface 140). In this embodiment, if nut 1518 becomes partially loosened (e.g., by a half or full rotation), biasing element 2315 may maintain pressure between surface 53 of port 48 and front surface 140 of post 116, which may help maintain electrical continuity and shielding.

The foregoing description of exemplary embodiments provides illustration and description, but is not intended to be exhaustive or to limit the embodiments described herein to the precise form disclosed. Modifications and variations are possible in light of the above teachings or may be acquired from practice of the embodiments.

As another example, various features have been mainly described above with respect to a coaxial cables and connectors for securing coaxial cables. In other embodiments, features described herein may be implemented in relation to other types of cable or interface technologies. For example, the coaxial cable connector described herein may be used or usable with various types of coaxial cable, such as 50, 75, or 93 ohm coaxial cable, or other characteristic impedance cable designs.

As discussed above, embodiments disclosed provide for a coaxial connector including a biasing element, wherein the biasing element is configured to provide a force to maintain the electrical path between the mating connector and the coaxial cable. In some embodiments, the biasing element is external to the nut and the connector body (e.g., biasing elements 115, 915, 1215, 1515, 1815, 2015, and 2315). In some embodiments, the biasing element may surround a portion of the nut and a portion of the connector body (e.g., biasing elements 115, 915, 1215, 1515, 1815, 2015, and 2315).

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A coaxial cable connector for coupling a coaxial cable to a mating connector, the coaxial cable connector comprising:

a connector body extending along a longitudinal axis and having a forward end and a rearward cable receiving end for receiving a cable;

a nut rotatably coupled to the forward end of the connector body;

an annular post disposed within the connector body for providing an electrical path between the mating connector and the coaxial cable; and a biasing element external to the nut and surrounding a portion of the connector body, wherein the biasing element is configured to engage an external and radially extending surface of the nut, and engage an external and radially extending surface of the connector body when the connector is in an assembled state so as to provide a force to maintain the electrical path between the mating connector and the annular post.

2. The coaxial connector of claim 1, wherein the connector body includes an outwardly protruding flange on the outer surface of the connector body, wherein the nut includes an outwardly protruding flange on the outer surface of the nut, and wherein the biasing element contacts the outwardly protruding flange of the connector body and the outwardly protruding flange of the nut to provide the force.

3. The coaxial connector of claim 2, wherein the biasing element includes an annular portion to support hooks to hook onto the outwardly protruding flange of the nut and the outwardly protruding flange of the connector body.

4. The coaxial connector of claim 3, wherein the hooks include forward-facing hooks and rearward-facing hooks, wherein the forward-facing hooks are configured to snap over the outwardly protruding flange of the nut and the rearward-facing hooks are configured to snap over the outwardly protruding flange of the nut.

5. The coaxial connector of claim 2, wherein the biasing element includes an elastomeric material coupled to the annular flange of the nut and the annular flange of the connector body.

6. The coaxial connector of claim 5, wherein the biasing element is molded over the nut or molded over the connector body.

7. The coaxial connector of claim 5, wherein the biasing element is molded over the nut and an annular ring.

8. The coaxial connector of claim 7, wherein the biasing element is coupled to the flange of the connector body through the annular ring.

9. The coaxial connector of claim 8, wherein the biasing element or annular ring is configured to snap over the outwardly-protruding flange of the connector body.

10. The coaxial connector of claim 5, wherein the biasing element includes an uneven outer surface.

11. The coaxial connector of claim 1, wherein the biasing element provides a force to prevent the nut from backing off the mating connector.

12. A coaxial cable connector for coupling a coaxial cable to a mating connector, the coaxial cable connector comprising:

a connector body extending along a longitudinal axis and having a forward end and a rearward cable receiving end for receiving a cable;

a nut rotatably coupled to the forward end of the connector body, wherein the nut includes internal threads for mating to external threads of the mating connector;

an annular post disposed within the connector body for providing an electrical path between the mating connector and the coaxial cable; and a biasing element radially external to the nut and surrounding a portion of the connector body, wherein the biasing element is configured to engage an external and radially extending surface of the nut and engage an external and radially extending surface of the connector body to provide a force to maintain tension between the internal threads of the nut and the external threads of the mating connector.

13. The coaxial cable connector of claim 12, wherein the nut includes a forward portion and a rear portion, wherein the forward portion and rear portion are configured to move relative to each other along an axial direction.

14. The coaxial connector of claim 13, wherein the rear portion of the nut is rotatably captured between the connector body and a flange of the post, and wherein the rear portion of the nut includes a recess, and wherein the front portion of the nut includes an outwardly protruding flange on the outer surface of the front portion of the nut.

15. The coaxial connector of claim 14, wherein the biasing element is coupled to the outwardly protruding flange of the front portion of the nut and the recess of the rear portion of the nut.

16. The coaxial connector of claim 14, wherein the biasing element is an elastomeric material molded over the front portion of the nut and the rear portion of the nut.

17. The coaxial connector of claim 16, wherein the elastomeric material forms a sealing element between the connector body and the rear portion of the nut.

18. The coaxial connector of claim 14, wherein the front portion of the nut includes an inwardly facing flange and the rear portion of the nut includes an outwardly facing flange, wherein the inwardly facing flange and the outwardly facing flange abut to prevent the front portion of the nut and the rear portion of the nut from moving in the axial direction away from each other.

19. A coaxial cable connector for coupling a coaxial cable to a mating connector, the coaxial cable connector comprising:

a connector body having a forward end and a rearward cable receiving end for receiving a cable;

a nut rotatably coupled to the forward end of the connector body, wherein the nut includes internal threads for mating to external threads of the mating connector;

an annular post disposed within the connector body for providing an electrical path between the mating connector and the coaxial cable; and a biasing element external to the nut and the connector body, wherein the biasing element is configured to provide a force between radially extending surfaces of the nut and the connector body to maintain electrical contact between the post and the mating connector.

20. The coaxial cable connector of claim 19, wherein the biasing element includes elastomeric material.

21. A coaxial cable connector for coupling a coaxial cable to a mating connector, the coaxial cable connector comprising:

a connector body having a forward end and a rearward cable receiving end for receiving a cable;

a coupling member rotatably coupled to the forward end of the connector body;

an annular post disposed within the connector body for providing an electrical path between the mating connector and the coaxial cable; and an elastomeric biasing element external to the coupling member and the connector body and surrounding a portion of the connector body, wherein the biasing element is configured to provide a force between radially extending surfaces of the coupling member and the connector body to maintain the electrical path between the mating connector and the annular post.

22. A coaxial cable connector comprising:

a body member configured to engage a cable when the connector is in an assembled state and having an outwardly extending body member portion;

a coupling member configured to engage an interface port when the connector is in the assembled state and having an outwardly extending coupling member portion;

a post member configured to form an electrical path between the interface port and the cable when the connector is in the assembled state; and an external biasing member configured to engage the outwardly extending body member portion and the outwardly extending coupling member portion when the connector is in the assembled state so as to exert a tension force between the coupling member and body member and maintain the electrical path between the interface port and the cable when the connector is in the assembled state.

23. The connector of claim 22, wherein the external biasing member is configured to exert the tension force against the outwardly extending coupling member portion toward a rearward direction when the connector is in the assembled state.

24. The connector of claim 23, wherein the external biasing member is configured to exert the tension force against the outwardly extending body member portion toward a forward direction when the connector is in the assembled state.

25. The connector of claim 22, wherein the external biasing member is configured to exert the tension force against the coupling member toward a rearward direction when the connector is in the assembled state.

26. The connector of claim 25, wherein the external biasing member is configured to exert the tension force against the body member toward a forward direction when the connector is in the assembled state.

27. The connector of claim 22, wherein the outwardly extending body member portion faces a rearward direction and the external biasing member is configured to exert the tension force against the outwardly extending body member toward a forward direction when the connector is in the assembled state.

28. The connector of claim 22, wherein the outwardly extending coupling member portion faces a forward direction and the external biasing member is configured to exert the tension force against the outwardly extending coupling member portion toward a rearward direction when the connector is in the assembled state.

29. The connector of claim 22, wherein the coupling member includes a port engagement portion and the interface port includes a coupling member engagement portion, and the external biasing member is configured to exert a biasing force between the port engagement portion of the coupling member and the coupling member engagement portion of the interface portion so as to help maintain the electrical path between the interface port and the cable when the connector is in the assembled state.

30. The connector of claim 29, wherein the port engagement portion of the coupling member comprises at least one internal thread, and the coupling member engagement portion of the interface port comprises at least one external thread shaped to substantially fit the at least one internal thread of the post engagement portion of the coupling member and form an electrical path between the coupling member and the interface port when the connector is in the assembled state.

31. The connector of claim 22, wherein the coupling member is configured to move between a first position relative to the body member, where the post member forms the electrical path between the interface port and the cable when the connector is in the assembled state, and a second position relative to the body member, where the electrical path between the interface port and the cable is interrupted, and wherein the external biasing member is configured to prevent the electrical path from being interrupted by exerting the tension force between the coupling member and the body member so as to prevent the coupling member from moving to the second position when the connector is in the assembled state.

32. The connector of claim 22, wherein the body member includes an outwardly protruding flange, the nut includes an outwardly protruding flange, and the external biasing member is configured to contact the outwardly protruding flange of the body member and the outwardly protruding flange of the coupling member so as to provide the tension force.

33. The connector of claim 32, wherein the external biasing element includes a first engagement portion shaped to engage the outwardly protruding flange of the coupling member and a second engagement portion spaced from the first engagement portion and shaped to engage the outwardly protruding flange of the body member.

34. The connector of claim 33, wherein the first engagement portion of the external biasing member comprises an inwardly shaped hook proximate a forward end of the biasing member and the second engagement portion of the external biasing member comprises an inwardly shaped hook proximate a rearward end of the biasing member.

35. A coaxial cable connector comprising:

a body member having an outwardly extending body member portion and configured to engage a cable when the connector is in an assembled state;

a coupling member having an outwardly extending coupling member portion and configured to engage an interface port when the connector is in the assembled state;

a post member configured to form an electrical path between the interface port and the cable when the coupling member is in a first position relative to the body member and to allow the electrical path to be interrupted when the coupling member is allowed to move to a second position relative to the body member; and an external biasing member configured to engage the outwardly extending body member portion and the outwardly extending coupling member portion when the connector is in the assembled state so as to exert a force between the coupling member and the body member, maintain the electrical path between the interface port and the cable, and prevent the electrical path from being interrupted by preventing the coupling member from moving to the second position relative to the body member when the connector is in the assembled state.

36. The connector of claim 35, wherein the force comprises a tension force.

37. The connector of claim 35, wherein the external biasing member is configured to exert a tension force against the outwardly extending coupling member portion toward a rearward direction when the connector is in the assembled state.

38. The connector of claim 35, wherein the external biasing member is configured to exert a tension force against the outwardly extending body member toward a forward direction when the connector is in the assembled state.

39. The connector of claim 35, wherein the external biasing member is configured to exert a tension force against the coupling member toward a rearward direction when the connector is in the assembled state.

40. The connector of claim 35, wherein the external biasing member is configured to exert a tension force against the body member toward a forward direction when the connector is in the assembled state.

41. The connector of claim 35, wherein the outwardly extending body member portion faces a rearward direction and the external biasing member is configured to exert a tension force against the outwardly extending body member toward a forward direction when the connector is in the assembled state.

42. The connector of claim 35, wherein the outwardly extending coupling member portion faces a forward direction and the external biasing member is configured to exert a tension force against the outwardly extending coupling member portion toward a rearward direction when the connector is in the assembled state.

43. The connector of claim 35, wherein the coupling member includes a port engagement portion and the interface port includes a coupling member engagement portion, and the external biasing member is configured to exert a biasing force between the port engagement portion of the coupling member and the coupling member engagement portion of the interface portion so as to help maintain the electrical path between the interface port and the cable when the connector is in the assembled state.

44. The connector of claim 43, wherein the post engagement portion of the coupling member comprises at least one internal thread, and the coupling member engagement portion of the interface port comprises at least on external thread shaped to substantially fit the at least one internal thread of the post engagement portion of the coupling member and form the electrical path between the coupling member and the interface port when the connector is in the assembled state.

* * * * *